US005914491A

United States Patent [19]

Salokatve et al.

[11] Patent Number: 5,914,491

[45] Date of Patent: Jun. 22, 1999

[54] DETECTOR FOR DETECTING PHOTONS OR PARTICLES, METHOD FOR FABRICATING THE DETECTOR, AND MEASURING METHOD

[76] Inventors: Arto Salokatve, Lindforsinkatu 8 B 33, FIN-33720 Tampere; Mika Toivonen, Miekkakatu 13 A 5, FIN-33530 Tampere; Marko Jalonen, Arkkitehdinkatu 20 A 1, FIN-33720 Tampere; Hannu Kojola, Turunitie 346, FIN-21870 Riihikoski; Markus Pessa, Miekkakatu 13 C, FIN -33530 Tampere, all of Finland

[21] Appl. No.: 08/700,441

[22] PCT Filed: Feb. 17, 1995

[86] PCT No.: PCT/FI95/00080

§ 371 Date: Nov. 19, 1996

§ 102(e) Date: Nov. 19, 1996

[87] PCT Pub. No.: WO95/22834

PCT Pub. Date: Aug. 24, 1995

[30] Foreign Application Priority Data

Feb. 17, 1994 [FI] Finland ..... 940740

[51] Int. Cl.[6] ..... H01J 43/04

[52] U.S. Cl. ..... 250/370.01; 257/10

[58] Field of Search ..... 250/370.1, 370.12, 250/370.13, 370.14, 207; 257/10, 21, 438, 439; 313/103 R

[56] References Cited

U.S. PATENT DOCUMENTS 4,586,068 4/1986 Petroff et al. ..... 257/438
5,374,826 12/1994 La Rue et al. ..... 250/397

*Primary Examiner*—Edward P. Westin
*Assistant Examiner*—Richard Hanig
*Attorney, Agent, or Firm*—Kubovcik & Kubovcik

[57] ABSTRACT

The object of the invention is a photon or particle detector which comprises a transmission dynode situated in a vacuum. The detector comprises a monolithically fabricated semiconductor structure in which electrons are arranged so as to travel from the semiconductor into a vacuum. At least a part of the multiplication region is formed into a layered structure incorporating at least one doped semiconductor transmission dynode and at least one vacuum space.

24 Claims, 27 Drawing Sheets

BARRIER

MULTIPLICATION STAGE LAYER

CONTACT METAL $Al_x Ga_{1-x} As$ $(x > 0.6)$

AR/ PASSIVATION

CONTACT LAYERS

METTALLIZED SURFACE $Al_x Ga_{1-x} As$ $(x < 0.4)$ (ABSORBTIONLAYER)

OPENING

PILLAR

ETCHED PATTERN

DETECTOR FOR DETECTING PHOTONS OR PARTICLES, METHOD FOR FABRICATING THE DETECTOR, AND MEASURING METHOD

The object of the invention is a photon or particle detector comprising one or more transmission elements surrounded by a sufficient vacuum.

1. PRIOR ART

To detect photons, photodetectors are used for converting the optical signals of light quanta, that is photons, to electrical signals. The photons are absorbed in the absorption region of the detector, thus forming charge carriers which are an electron and a hole, or an electron alone. Detectors functioning in the visible light region, or in the vicinity of this region, can be divided into two groups: solid state photodetectors and vacuum tube photodetectors. Both groups include several different detector types for different applications. It is also possible to detect particles by means of similar detectors, depending on the energy of the particles.

1.1 Conventional Solid State Detectors

As photons are absorbed or particles collide with a semiconductor, at least one free primary charge carrier is created in the solid state semiconductor detectors. If the number of photons reaching the detector is small, the primary signal formed by the electrons or holes created must be amplified in order for the photons to be detected. Amplification may be performed either by an external amplifier or by internal gain in the detector.

The most common photodetector incorporating a unity gain is a p-i-n photodiode by means of which an almost 100% quantum efficiency can be achieved. Internal amplification in a conventional avalanche photodiode (APD) is based on the fact that the primary charge carriers accelerated in an electric field have sufficient energy to ionize atoms by colliding with them. Sufficient energy is approximately 1.5 $E_g$, when $E_g$ is the energy gap of a semiconductor, that is, the valence-conduction band gap. The electron and hole created by ionization are then capable of ionizing new atoms. This process is called avalanche multiplication.

However, a problem of both the external amplifier and avalanche multiplication is considerable noise. It usually impairs the sensitivity of the detector to such a degree that detecting low luminosity is impossible. In addition, the noise increases radically as multiplication increases. The noise caused by multiplication is a particularly serious problem in compound semiconductor avalanche photodiodes, by means of which good quantum efficiency can be achieved also at long (>1 $\mu$m) wavelengths of light. In these diodes, the electron and hole—accelerated by a large electric field—ionize atoms with almost equal probability, which means that the noise caused by avalanche multiplication is at its highest level.

1.2 Conventional Unipolar Solid State Photomultiplier

In multiquantum well (MQW) structures consisting of semiconductors having small and large energy gaps ($E_g$), it is possible to achieve so-called unipolar avalanche multiplication. The semiconductor layers with a smaller energy gap ($E_g$), that is, quantum wells (QW), are doped with impurity atoms which, as a result of low thermal energy, ionize and release charge carriers-to the quantum well. In unipolar avalanche multiplication, the primary charge carrier—the electron or the hole—collides with the charge carriers stored in the quantum wells formed on the conduction band (electrons) or valence band (holes). Thus only one type of the charge carriers, the electron or the hole, is involved in multiplication. In this case multiplication causes little noise.

If the quantum wells are doped with donors, unipolar electron multiplication is detected. If, on the other hand, the quantum well layers are doped with acceptors, unipolar hole multiplication is detected. To achieve multiplication, the primary charge carrier must have sufficient kinetic energy to ionize charge carriers from the quantum well. The magnitude of the multiplication can be assessed by the expression $M=g^N$, where g=multiplication per stage N=number of multiplication stages In order to maintain multiplication continuously on the same level, the wells must be kept full, for example, by means of thermal or optical excitement or by bringing the wells into contact with an external circuit. When the number of electrons in the quantum well is constant, multiplication (g) per stage is constant.

The electrons released from the quantum wells by means of thermal energy increase dark current, which is a major problem in connection with unipolar solid state photomultipliers (SSPM). In order to minimize the dark current, the potential barrier material between the quantum wells should be as resistive as possible and the quantum wells deep. It is difficult to meet these requirements in practice.

The basic structure $In_yGa_{1-y}As/Al_xGa_{1-x}As$ of a known unipolar solid state photodetector (SSPM) for unipolar electron multiplication is shown in FIG. 5 below. In this structure, the p-i-n absorption area is biased separately in the reverse direction in order to ensure that only the electrons are injected in the multiplication region, that is, the multi-quantum well region (MQW-Region). The multiplication region is biased in the same direction as the absorption area. If the holes are to be multiplied, the p-i-n structure of the absorption area is reversed to the structure n-i-p, and both biasing circuits are also reversed, and the quantum well layers are doped with acceptors.

1.3 Vacuum Tube Detectors

The photomultiplier tube (PMT) is the most common vacuum tube photodetector. It is of macromechanical structure and it consists of several parts. The parts include at least a photocathode, different connecting pieces and successive multiplication stages, or dynodes, inside the vacuum tube. The photons absorbing in the photocathode create photoelectrons as a result of a photoelectric effect. Both the photocathode and the dynodes are often coated with a thin layer which reduces the electron affinity of the photocathode and the dynode. In this way it is sufficiently easy for the electrons to travel from both the photocathode and the dynode out into the vacuum. The coating substance is often a material containing caesium (Cs). The primary electrons released from the photocathode into the vacuum are accelerated by means of a large electric field towards the first dynode, the next dynode, and so on through each dynode, to the anode. The dynodes may be both surface emitting and transmissive multiplication elements. In surface emitting dynodes, new electrons are generated due to secondary electron emission. In a transmission dynode, new electrons are generated through atomic ionization One example of a vacuum tube photodetector equipped with a transmission dynode is disclosed in U.S. patent publication Ser. No. 3,513,345. The publication describes a structure in which several transmission dynodes are situated in a vacuum tube.

The electric field is divided in the desired manner by means of an external resistance network. The operating voltages between the multiplication stages are typically about 100 V. Since the electrons' flight times between the different stages are long, due to the macroscopic distances (>1 mm), the signal response is relatively slow. In addition, quantum efficiency is poor, that is, <10%, particularly when the wavelength is longer than 1 $\mu$m. Even with shorter wavelengths (<1 $\mu$m), a maximum quantum efficiency of only about 30% is achieved. The apparatus is complex and large and requires an extremely good vacuum to function. On the other hand, the noise caused by multiplication and dark current are often low even at high multiplication values, that is, at multiplication of about $10^6$–$10^7$. The dark current is a current existing in the measuring device even without a light signal.

1.4 Macromechanical Vacuum Avalanche Photodiode (VAPD), or an APD/PMT Hybrid A macromechanical vacuum avalanche photodiode (VAPD) consists of several parts, as did the photomultiplier tube (PMT). In a VAPD, the absorption area is a photocathode which is connected to a solid state avalanche multiplication region (APD). The device is mounted in a vacuum enclosure The detector requires high operating voltages, typically about 8 kV. In addition, the quantum efficiency is as poor as with the PMT. A device of this type is disclosed in the publication: Robert S. Clark: Avalanche photodiode: low-light challenge to the photomultiplier tube, SPIE Reports, No. 119/November 1993, SPIE—The International Society for Optical Engineering.

2. THE DETECTOR RELATING TO THE INVENTION

An invention by means of which the dark current of a solid state photodetector (SSPM) can be considerably reduced and its internal gain increased is described in the following. It is characteristic of the detector relating to the invention that the detector comprises at least one monolithically fabricated semiconductor structure, in which electrons are arranged so as to travel from the semiconductor, either directly or through a medium, to a vacuum space.

The invention consists of a new type of solid state photodetector (SSPM) in which at least one of the surfaces of the transmission element, made at least partly of a semiconductor, is surrounded by a sufficient vacuum. If there are several transmissive multiplication elements, they are also separated from each other, at least partly, by a vacuum space. According to the invention, this is accomplished by combining semiconductor techniques and vacuum techniques in a new way. The detector relating to the invention is made by arranging one or more vacuum spaces in a known solid state photodetector (SSPM), and the invention presented in this application is called: a Vacuum Space Solid State Detector (VSSD).

The detector relating to the invention does not have the disadvantages of known detectors—while it does have the best properties of the detector types described above. The absorption area of the new detector has good quantum efficiency, as has an avalanche photomultiplier (APD), and the internal gain of the detector is high. It is also almost completely noiseless, like a photomultiplier tube (PMT). The magnitude of multiplication can be calculated in the same way as explained above in connection with a solid state photodetector (SSPM).

The structure of the detector also allows both small and large detector surfaces, spatial resolution, compatibility with microelectronic processes and rapid signal response.

In addition, in a micromechanical structure, the vacuum required by the vacuum space solid state detector (VSSD) can be considerably inferior to that required by a photomultiplier tube (PMT). This type of a vacuum is obviously also much easier to maintain.

The light absorption area of a vacuum space solid state detector (VSSD) may consist of either a semiconductor structure, as in an avalanche photodiode (APD), or a separate photocathode, as in a photomultiplier tube (PMT). In the multiplication region, the multiplication stage, which is a transmissive element, is supported on at least one of its surfaces by intermediate elements of appropriate size which can be, for example, pillars. If the pillars in a micromechanical structure are sufficiently thick and sufficiently close to each other, the structure remains intact. The strength of the structure also depends on the thicknesses of the absorption area and the multiplication stage layers.

In the multiplication region the layers between pillars, and in the contact area the layers between contact layers must be as resistive as possible to minimize dark current. Compared with a solid state photodetector (SSPM), the vacuum space solid state detector (VSSD) provides better possibilities for eliminating dark current. This is due to the fact that in fabricating the vacuum structure, resistive layers have been removed from areas which are significant for detecting the signal. Thus the layers between multiplication stages can be made of materials that are capable of preventing a current from travelling and/or the formation of dark current.

In a vacuum space solid state detector (VSSD), both the absorption area and the multiplication stage or multiplication stages must be brought into contact with an external voltage source in order for the electrons to be accelerated across the vacuum space to speeds that suffice to achieve the desired multiplication in the multiplication stage. In a vacuum space solid state detector (VSSD) the voltages required between the multiplication stages are, however, lower than in a photomultiplier tube (PMT), because good collection efficiency is already achieved at relatively low voltages. This is due to the fact that in a micromechanical structure, the distances (<10 $\mu$m) between multiplication stages in the vacuum space solid state detector (VSSD) are much shorter than in a photomultiplier tube (PMT) (>1 $\mu$m). Due to the small vacuum space, the micromechanical vacuum space solid state detector (VSSD) is not as sensitive to external electromagnetic fields as the photomultiplier tube (PMT).

The essential aspect of a macromechanical structure is that the multiplication element is a monolithically fabricated transmissive multiplication element, the structure of which is at least partly based on a semiconductor. In addition, at least two of the doped layers of the semiconductor structure are in contact with an external voltage circuit.

In the multiplication stage of a vacuum space solid state detector (VSSD), the multiplication of electrons can take place in at least two ways: through interaction between the primary electrons and the electrons of the conduction band, and through the ionization of atoms. In order for the electric field extending across the vacuum space and required for sufficient multiplication to be reasonable, the electron emitting surfaces often have to be coated with a thin caesium-containing layer, for the same reason as in the photomultiplier tube (PMT). Even negative electron affinity can be achieved if there is a $p^+$ semiconductor layer on the electron emitting surface, on which layer the caesium atoms (Cs) are deposited.

Possible materials for a solid state photodetector (SSPM) without a vacuum space, and a vacuum space solid state detector (VSSD) include $GaAs/Al_xGa_{1-x}As$, GaAs/AlAs, $InyGa_{1-y}As/AlGaAs$, $In_{0.53}Ga_{0.47}As/In_{0.52}Al_{0.48}As$, $In_{0.53}Ga_{0.47}AS/InP$, $In_{0.52}AL_{0.48}As/InP$, $GaN/Al_xGa_{1-x}N$, and suitable combinations of these, both lattice-matched and strained layers. Good quantum efficiency—even as high as >80%—can be achieved in the absorption area by means of these materials, at least at wavelengths shorter than 1.6 $\mu$m.

3. FABRICATION OF THE DETECTOR RELATING TO THE INVENTION

The fabrication of a vacuum space solid state detector (VSSD), and of a conventional solid state photodetector (SSPM), consists of growing a multiquantum well (MQW) structure by means of a method suitable for growing layered structures. Such methods include, for example, molecular beam epitaxy (MBE), chemical beam epitaxy (CBE) and metal organic chemical vapour deposition (MOCVD). In addition to conventional lithographic technique, the processing of both detectors requires a method by means of which one or more layers of the absorption area and each multiplication stage can be brought into contact with an external resistance network. The method used for making the contact depends on the materials used. Fabricating the vacuum structure in the multiplication region of a solid state detector provided with one or more vacuum spaces (VSSD) is a very complex process.

The invention also relates to a method for fabricating a photon or particle detector. It is characteristic of the method relating to the invention that at least one monolithic semiconductor structure is grown into the detector, from which structure electrons travel to a vacuum, either directly or through a medium. The method is explained in greater detail in the following, in connection with the drawings and claims.

3.1 The Methods for Making Contacts to the Multiplication Stages

According to the invention, two methods have been developed for making contacts to the lower edge of the absorption area of both the micromechanical vacuum space solid state detector (VSSD) and the solid state photodetector (SSPM) and the multiplication stages, namely selective etching and lapping. The contact areas of the layers to be brought into contact can be exposed by means of these techniques. After this, the contact areas can be metallized by conventional lithographic technology.

3.1.1 Selective Etching

Selective etching is based on an etchant which is, for example, a liquid or gaseous plasma and etches one material much more rapidly than another. According to this principle, a cavity can be etched through the entire multilayer structure, layer by layer, when two successive layers are exposed to etchants which are selective with respect to each other.

Example 1

$GaAs/Al_xGa_{1-x}As$, where x>0.5.

The MQW structure can be pierced by etching the GaAs layer with an $NH_4OH:H_2O_2$ solution, having a mixture ratio of 1:30. The AlGaAs layer, on the other hand, is etched with an $HF:H_2O$ solution, having a mixture ratio of 1:n. The greater the value of n, the slower the etching speed.

Example 2

$In_{0.53}Ga_{0.47}As/InP$

The structure can be pierced layer by layer by etching the InGaAs layer with a citric acid $H_2O_2$ solution, having a mixture ratio of 1:1. The InP layer is etched with an $HCl:H_3PO_4$ solution, having a mixture ratio of 1:1.

Table A shows other etching solutions suitable for the selective etching of different structures. By means of the structures and etchants given in Table A it is possible to etch a cavity down to the desired layer and to metallize the bottom of the cavity by utilizing lithography. In this way each multiplication stage layer of the MQW structure can be exposed for making contacts separately. The latter etching solution for $In_{0.53}Ga_{0.47}As/In_{0.52}Al_{0.48}$. As structure is not known. For this structure, however, the sufficient area for contacts can be achieved by means of lapping Table A Examples of the Selective Etching Solutions of Different Materials (X and Y).

| X/Y | Etching rate of X much higher than that of Y | Etching rate of Y much higher than that of X |
|---|---|---|
| $GaAs/Al_xGa_{1-x}As$ | $NH_4OH:H_2O_2$ (1:30) | $HF:H_2O$ (1.3), x > 0.5 |
| $In_{0.53}Ga_{0.47}As/InP$ | citric acid:$H_2O_2$ (1:1) | $HCl:H_3PO_4$ (1:1) |
| $In_{0.52}Al_{0.48}As/InP$ | $HCl:H_3PO_4:CH_3COOH$ (1:1:2) | $HCl:H_3PO_4$ (1:1) |
| *$In_{0.53}Ga_{0.47}As/In_{0.52}Al_{0.48}As$ | citric acid:$H_2O_2$ (1:1) | not known |

In addition to using an etching liquid, selective etching can also be performed by means of suitable dry etching. For example, the GaAs layer can be pierced by means of the reactive ionic plasma generated from $CCl_2F_2$ gas by means of a radio frequency generator (RF-generator). In dry etching the edges of the etched pattern are steep and follow the etching mask.

3.1.2 Lapping

The layers of a multilayer structure can be exposed on the surface of the sample by means of lapping, when the sample is lapped at a small angle. A sample structure is shown in FIG. 40 and in greater detail in FIG. 41 of the drawings.

The width of the layer (Z) on the surface of the sample depends on the lapping angle (a) in accordance with the following equation:

$L/Z = \sin(\alpha)$, where L=thickness of layer in the direction of growth.

Example:

$\alpha=0.1°$, $L_{QW}=0.1$ $\mu$m=thickness of multiplication stage in the direction of growth and $L_B=0.5$ $\mu$m=thickness of the intermediate layer in the direction of growth.

The corresponding widths on the surface are $Z_{QW}$~57 $\mu$m and $Z_B$~286 $\mu$m. These widths are wide enough to enable contact to be made by means of lithographic techniques. Thus it is possible to give multiplication stages contacting surfaces by means of the lapping technique, irrespective of the materials and etching properties of the MQW structure.

If it is desirable to expose the multiplication stage layers more widely on the surface of the sample, the lapped structure must be etched selectively so that only the intermediate layers become etched. This forms the step-like structure shown in FIG. 42.

Compared with the selective etching technique described above, the fabrication technique based on lapping is markedly faster because all the contact areas are exposed after one lapping stage. In selective etching there are more processing stages, the greater the number of multiplication stages to be given contacting surfaces in the structure.

3.2 Fabricating a Vacuum Structure

Fabricating a vacuum structure is based on selective etching. This method has been described in the following publication concerning the fabrication of optical microcavities: Seng-Tiong Ho et al., "High index contrast mirrors for optical microcavities", AT&T Bell Laboratories, Appl. Phys. lett. 57(4), 1 October 1990, American Institute of Physics.

The process of fabricating a vacuum structure can be started by etching cavities through the entire structure down to the substrate. An etchant that etches each material in the structure at approximately the same speed is used for this purpose. A suitable solution is, for example, $H_2SO_4$:$H_2O_2$:$H_2O$ solution or $H_3PO_4$:$H_2O_2$:$H_2O$ solution. Dry etching is also possible. In the GaAs/AlGaAs structure the cavities can be made, for example, by using $SiCl_4$ plasma. The cavities can also be made by applying strong laser light or by sputtering. In this way, a so-called cavity matrix is made in the active region, through which matrix the selective etching solution indicated in Table A can enter the structure. The selective etching solution used etches only the intermediate layer. Therefore, by discontinuing etching after a suitable period of time, in addition to the multiplication stages, there will only be pillars consisting of the intermediate material in the active region, as shown by FIGS. 28, 29, 45 and 46. Instead of the cavity matrix, other methods for feeding the selective etching solution into the structure may also be used, as shown in the drawings.

Etching speed may be regulated by altering the mixture ratio of the etching solution and/or by raising or lowering the temperature of the etching solution. Etching is discontinued, for example, by diluting the etching solution sufficiently with water. Etching may also be stopped gently by other means. The progression of etching can be controlled by other means than the etching time. According to another method, cavities are first etched through the detector structure The cavities are then filled with a resistive material, such as polyimide, the etching speed of which is much slower than that of the intermediate spaces to be etched.

According to a third method, pillars of the desired size are "marked" by means of a large and energetic proton or ion flux through the entire detector structure. In this case, the crystalline structure in the bombarded areas is damaged and the materials of the different layers of the MQW structure mix at least partly with each other. Thus the etching speed of the bombarded area slows down markedly. In addition, extremely electrically resistive pillars are obtained.

The proton or ion bombarding method works at least with a GaAs/$Al_xGa_{1-x}As$ MQW structure, where x>0.5. After bombarding, the molar ratio (x) of aluminium (Al) with respect to gallium (Ga) has decreased in the $Al_xGa_{1-x}As$ layers. If HF:$H_2O$ solution is now used, its etching speed is markedly slower when (x) decreases. At the same time, any possible leakage currents passing through the pillars can be eliminated However, for bombardment to be successful, a sufficiently thick mask there is required. As a mask can be used, for example, patterned $Si_3N_4$ film and a photoresist layer, the combined thickness of which is sufficient to stop an energetic particle flux in the area outside the pillars. Silicon dioxide film ($SiO_2$) or a polyimide layer can also be used as a mask.

It is advantageous if the contact areas are metallized before the fabrication of the vacuum structure, because the vacuum structure does not necessarily withstand the mechanical strain caused by making the contacts. After the contacts have been made, mesa etching is usually carried out, by means of which the components are separated from the surrounding structure. Thereafter the sample is coated with, for example, $Si_3N_4$ film, which acts as an anti-reflective and passivating layer at the same time.

To achieve negative or extremely low positive electron affinity, the electron emitting surfaces, that is, the lower edge of the absorption area and the lower surfaces of the multiplication elements if any must be coated with, for example, caesium (Cs). The caesium layer is evaporated onto the electron emitting surfaces of a completed vacuum structure under an adequate vacuum In a micromechanical cavity structure, the Cs atoms penetrate through the openings in the active region inside the structure and further onto the above-mentioned surfaces. In a macromechanical structure, evaporation is carried out as in a conventional photomultiplier tube (PMT). When the surfaces of the sample on which evaporation is to be carried out are at a sufficiently high temperature, the mobility of the Cs atoms introduced onto these surfaces is great. At the same time, the number of adhering Cs atoms is limited. For example, only less than one Cs atom layer adheres to the surface of GaAs (001) at room temperature. It is, therefore, easy to obtain an extremely thin Cs layer all over the structure on which evaporation is to be carried out.

Since each surface of the sample acquires a covering of Cs by Cs evaporation, the Cs layer must be sufficiently thin in order for the metallic Cs not to short-circuit the different multiplication stages, for example, through the pillars or the contact areas on the surface. It should, however, be noted that a film having a coverage less than a full monoatomic Cs layer is still extremely resistive. On the other hand, only less than one-atomic layer is required to minimize the effective electron affinity of the above-mentioned surfaces.

3.3 Structural Examples

The different structures and the materials used in them depend first of all on which of the above-mentioned two methods is used to create contact surfaces on the multiplication stages and secondly, on which material layer or layers are to be removed by means of selective etching, to form one or more vacuum spaces. The materials used and the thicknesses of the layers are also partly determined by the wavelength or particle energy for which the absorption area of the detector is to be made optimal In addition, the required magnitude of multiplication makes demands on different layers of the multiplication region in different structural solutions.

3.3.1 The Solid State Detector Provided With One or More Vacuum Spaces (VSSD) Relating to the Invention The structure of solid state detectors provided with one or more vacuum spaces (VSSD) may vary considerably depending on the object of application. The basic types are shown in the drawings below. It is common to them all that electrons travel at some stage from a monolithically fabricated, transmissive semiconductor element into a vacuum, either directly or through a medium The basic types are:

A. Micromechanical solutions:

a monolithic detector comprising at least one vacuum space for accelerating electrons a monolithic multiplication region comprising at least two vacuum spaces with as the absorption area either a separate photocathode or a separate semiconductor absorption area.

B. Macromechanical solution:

the multiplication region comprises one or more multiplication stages which are monolithic transmission dynodes. They are externally biased, that is, each multiplication stage includes at least two contact layers in contact with an external circuit.

The following alternative solutions also fall within the scope of the invention:

a. A readout stage acting as a position-sensitive collection anode whether is a monolithically fabricated element following the absorption area or multiplication region of the detector. A readout stage separate from the detector, such as a charge coupled device, or CCD element, may also be used.

b. There may be, inside the absorption area and multiplication stage an internal electric field an internal electric field and an electric field produced by means of external bias only an electric field produced by means of external bias no electric field at all c. In micromechanical structures, an intermediate layer is etched away selectively with respect to other layers from areas significant for detecting light. The intermediate material layer or layers are highly resistive, and thus leakage currents can be minimized High resistivity can be achieved, for example, as follows:

by means of a thick, fully intrinsic semiconductor, by means of one or more pn or p-i-n junctions biased externally in the reverse direction, by means of a semiconductor layer or layers grown at a sufficiently low temperature, by proton or ion bombardment.

The invention relates particularly to a photon or particle detector in which electrons transmit the primary signal on and travel at some stage from a monolithically fabricated, transmissive semiconductor element into a vacuum, either directly or through a medium Both between the absorption area and the multiplication stage and—in a structure comprising more than one multiplication stage—between one multiplication stage and another, there is a vacuum space in the areas important for the progressing of the signal. The electrons are accelerated in the vacuum space and multiplied in the multiplication stage.

The multiplication stage or stages are transmissive semiconductor elements which are brought into contact with an external circuit. Thus an electric field is produced in the vacuum space by means of external bias. If a multilayer multiplication stage is brought into contact from more than one doped layer, an electric field larger than the internal electric field of the semiconductor structure is produced inside the multiplication stage by means of bias. This means that the collection efficiency and multiplication of electrons can be increased. If the absorption area comprises more than one doped layer, more than one layer can also be brought into contact with external bias from the absorption area, in order to maximize its efficiency. In addition, by changing the doping of the multiplication stage or absorption area, an internal field is produced inside the corresponding elements. Also, by changing, for example, the Al/Ga molar ratio to AlGaAs, an internal field is produced inside the semiconductor.

In micromechanical structural solutions, contacts are made either by lapping or by etching selectively, layer by layer. As methods of making contacts, these form a part of the invention. In micromechanical solutions the vacuum space or spaces are also made by selective etching.

In macromechanical structural solutions transmissive multiplication elements are monolithically fabricated units comprising at least two different types of semiconductor layers, inside which a strong electric field has been generated by means of external bias through at least two layers in contact.

The multiplication stage structures of vacuum space solid state detectors (VSSD) and the methods of contacting may vary considerably, as shown in FIGS. 17–26. The choice of the structural solution, whether micromechanical or macromechanical, also determines the contacting methods applied. The greatest difference is in that the macromechanical realization requires at least two contacts per multiplication stage, whereas in the simplest micromechanical solution only a single multiplication stage is brought into contact with external circuit.

The invention also relates to a measuring method for detecting photons or particles, according to which method a photon is allowed to be absorbed in, or a particle to collide with the absorption area, in which case a primary signal formed by at least one electron is generated. It is characteristic of the measuring method relating to the invention that, for detecting photons or particles, at least one monolithically fabricated semiconductor structure is used, in which electrons are arranged so as to travel from the semiconductor into a vacuum space, either directly or through a medium.

The invention is explained by means of examples in the following, with reference to the appended drawings in which FIG. 1 shows diagrammatically a surface emitting dynode.

FIGS. 29*a*–29*d* show an example of the etching of a vacuum space solid state detector (VSSD) through cavity matrices.

Figure 30A:
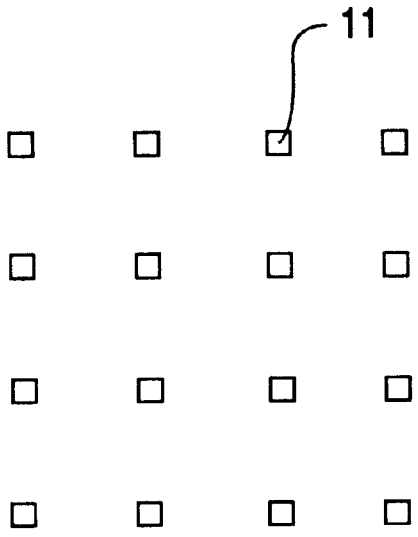
Figure 30B:
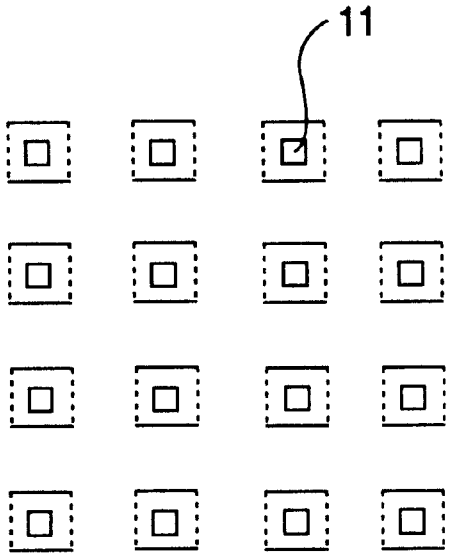
Figure 30C:
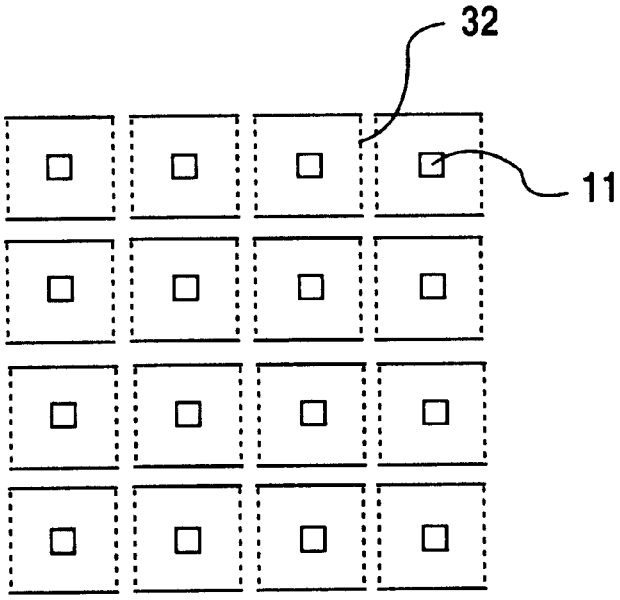

FIG. 30*a*–30*c* corresponds to FIG. 29 and shows another example of the etching of a vacuum space solid state detector (VSSD) through cavity matrices.

Figure 31:
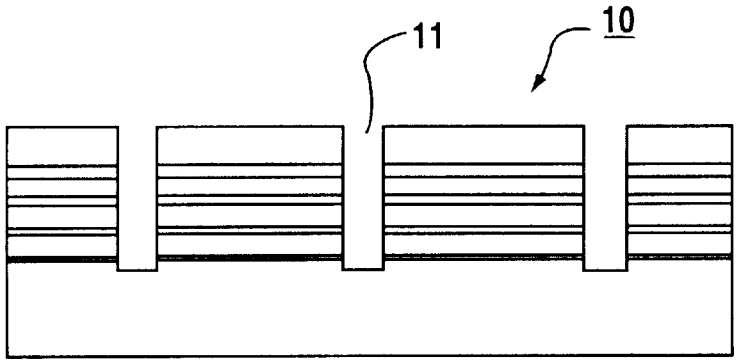
Figure 32:
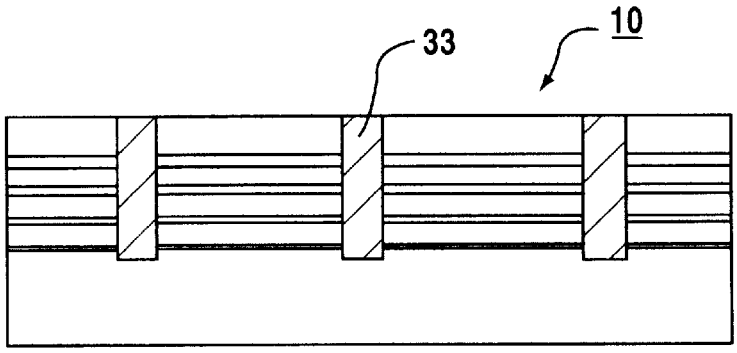
Figure 33:
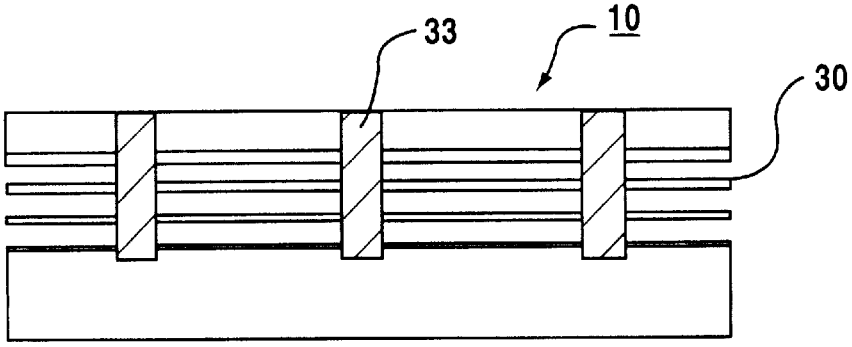

FIGS. 31–33 show, as a vertical section, the fabrication of a vacuum space solid state detector (VSSD) according to another method.

Figure 34:
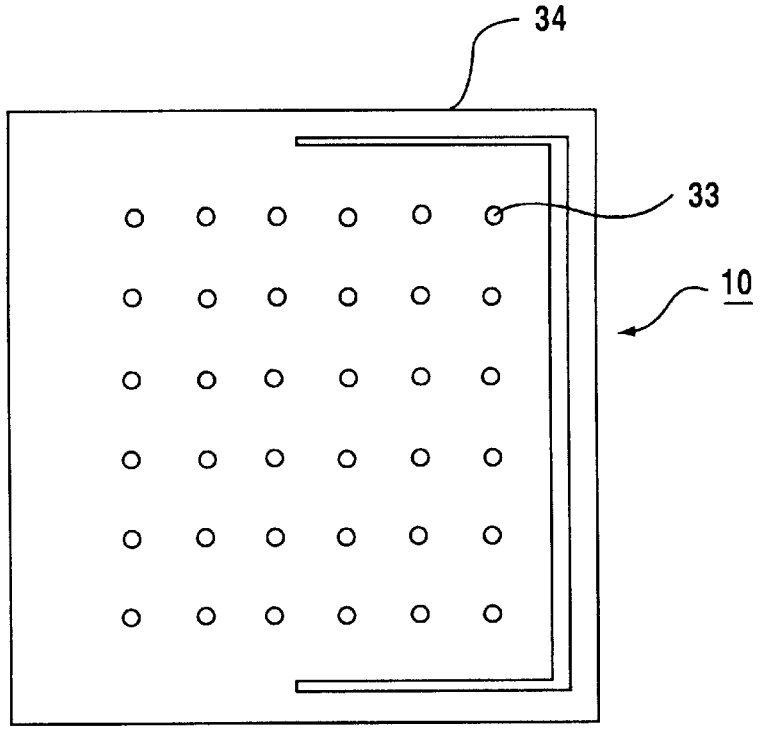

FIG. 34 shows diagrammatically the cavity matrix and etching channel of a micromechanical vacuum space solid state detector (VSSD).

Figure 35:
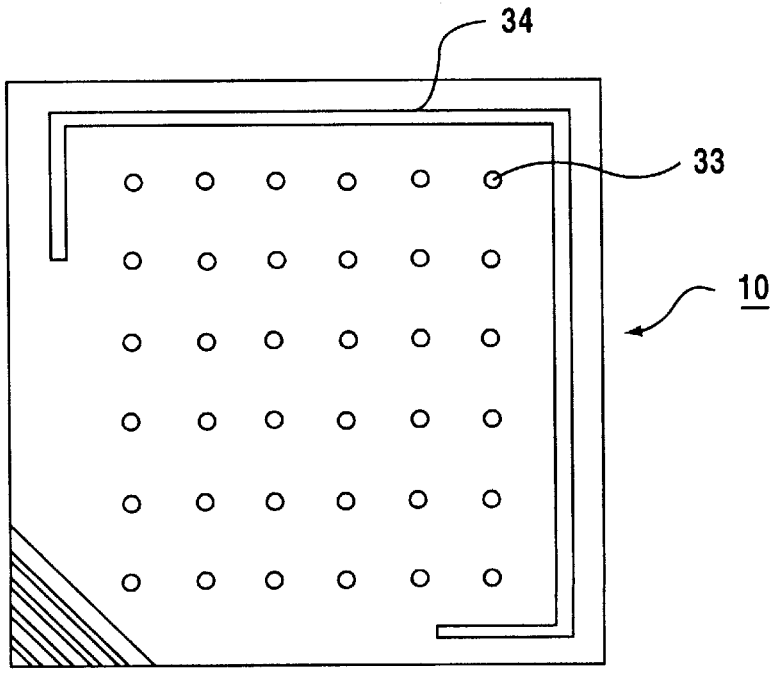

FIG. 35 corresponds to FIG. 34 and shows the cavity matrix and etching channel of the micromechanical structure according to another embodiment.

Figure 36:
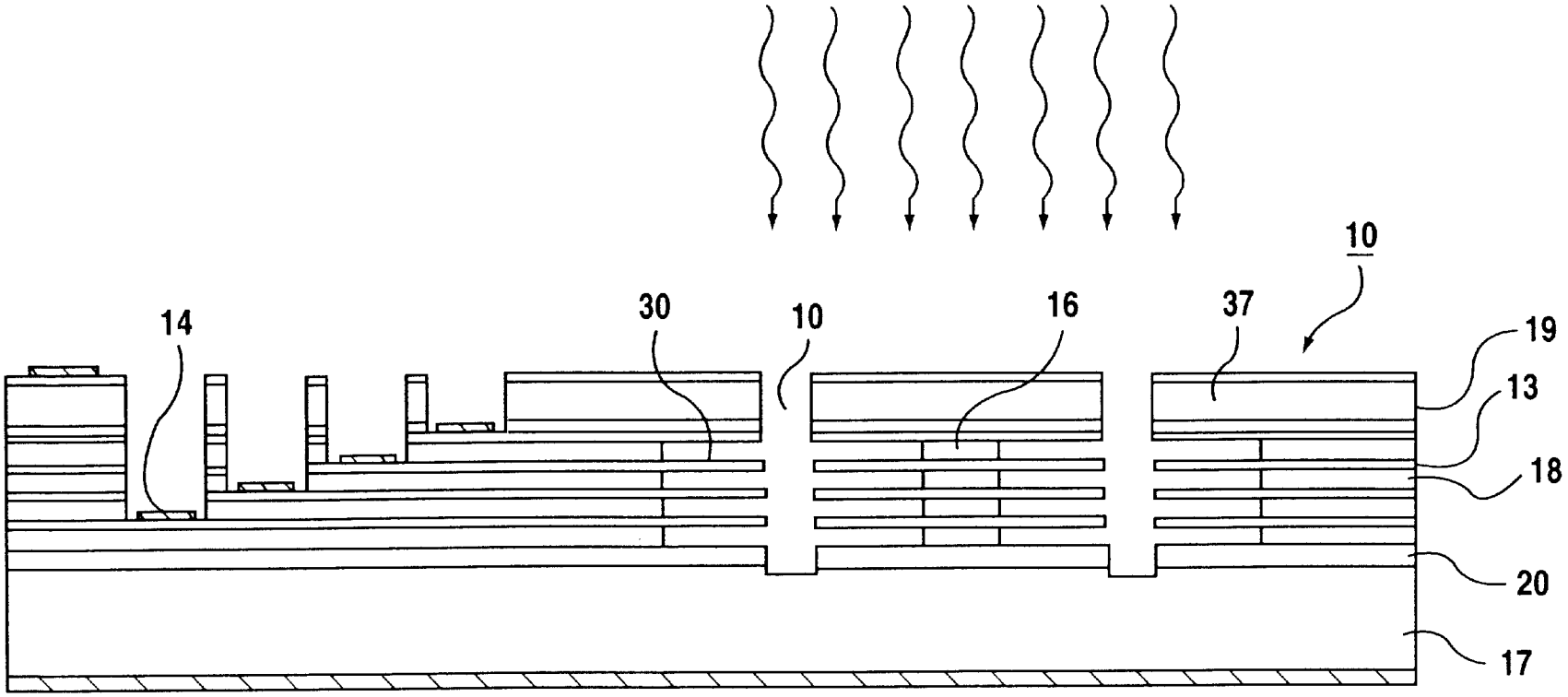

FIG. 36 shows a sectional view of the structures of the transmission elements of the vacuum space solid state detector (VSSD) and their contacts.

Figure 37:
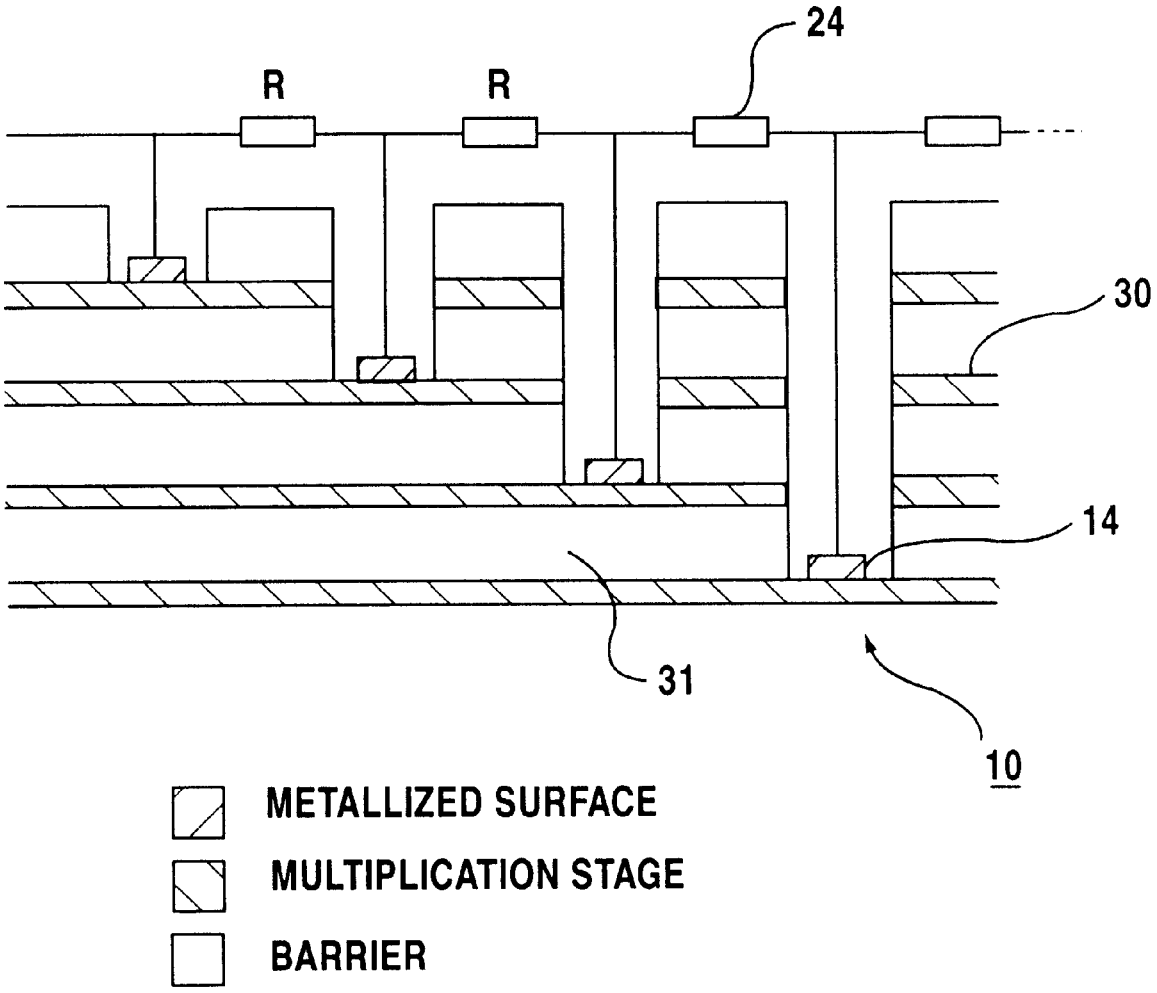

FIG. 37 shows a sectional and diagrammatic view of the contact fabrication in a multilayer structure by means of selective etching.

Figure 38:
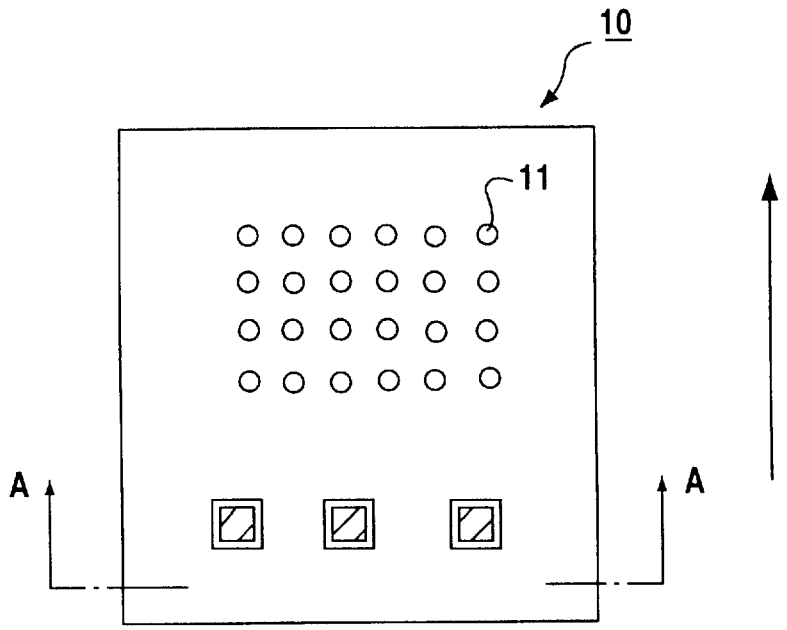

FIG. 38 shows a vacuum space solid state detector (VSSD) with etched contacts as seen from above.

Figure 39:
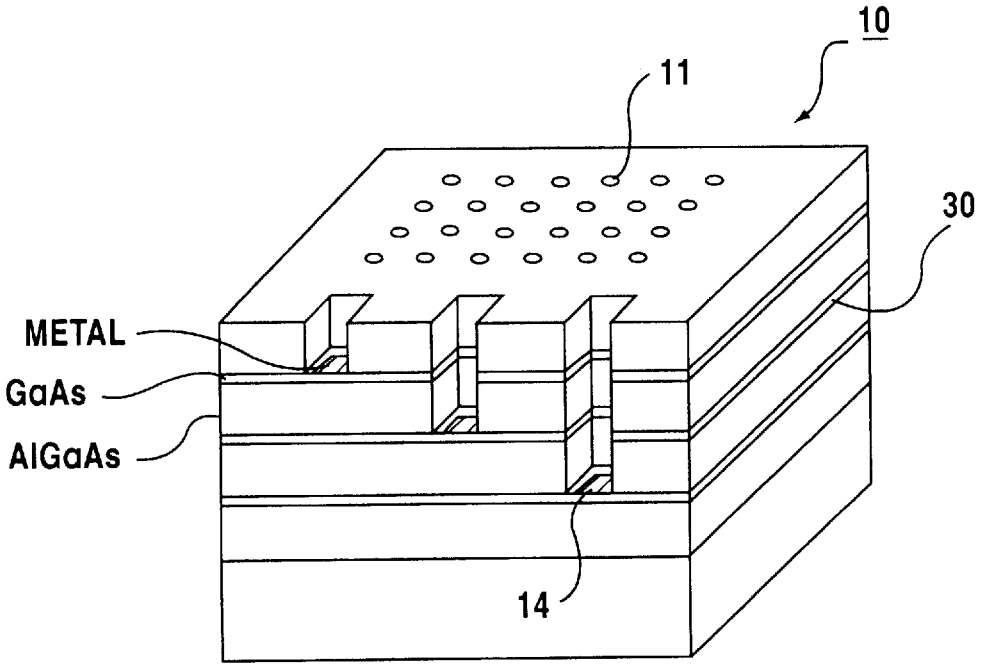

FIG. 39 shows a section of FIG. 38 along line A—A.

Figure 40:
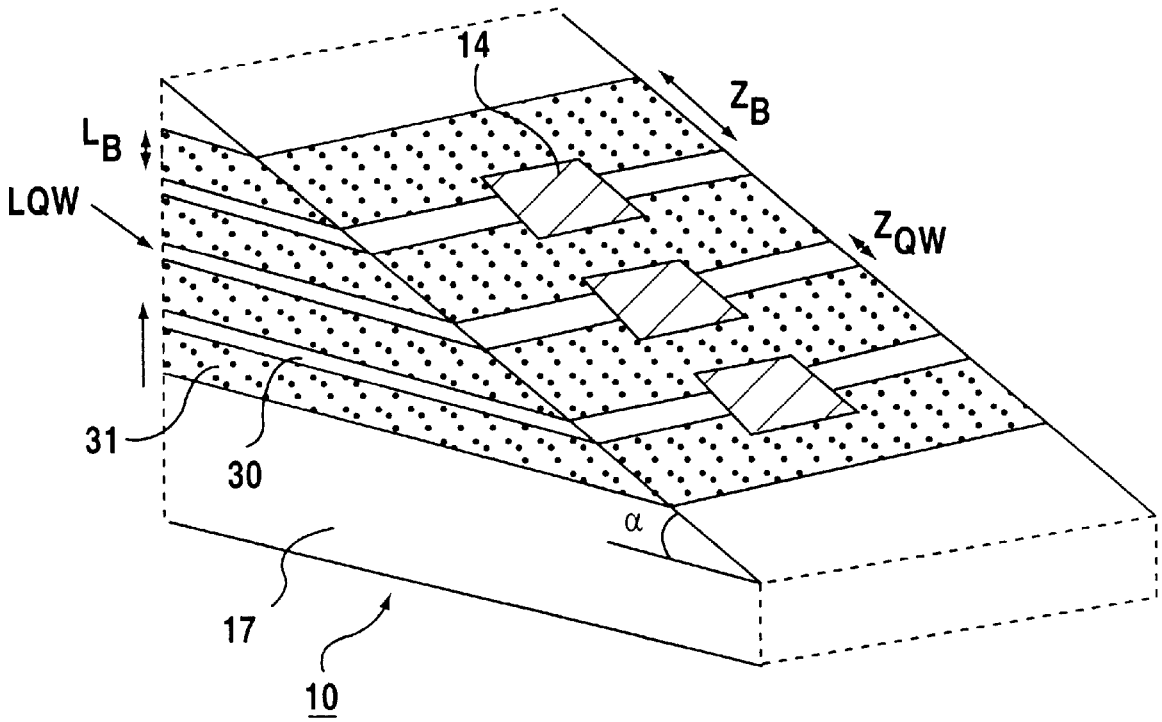

FIG. 40 shows the multilayer structure of a vacuum space solid state detector (VSSD) lapped to a small angle ($\alpha$), in which each layer has a separate contact.

Figure 41:
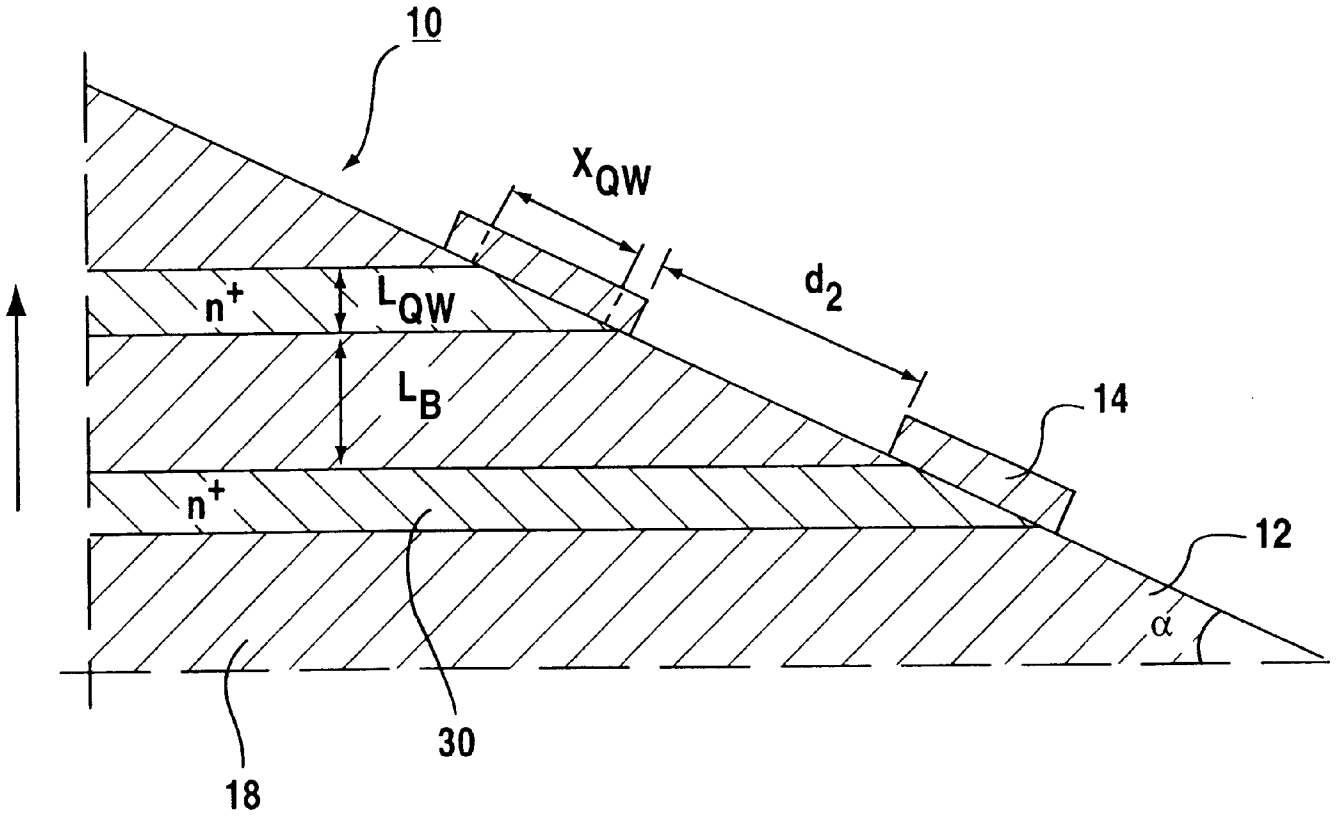

FIG. 41 shows diagrammatically a vertical section of FIG. 40.

Figure 42:
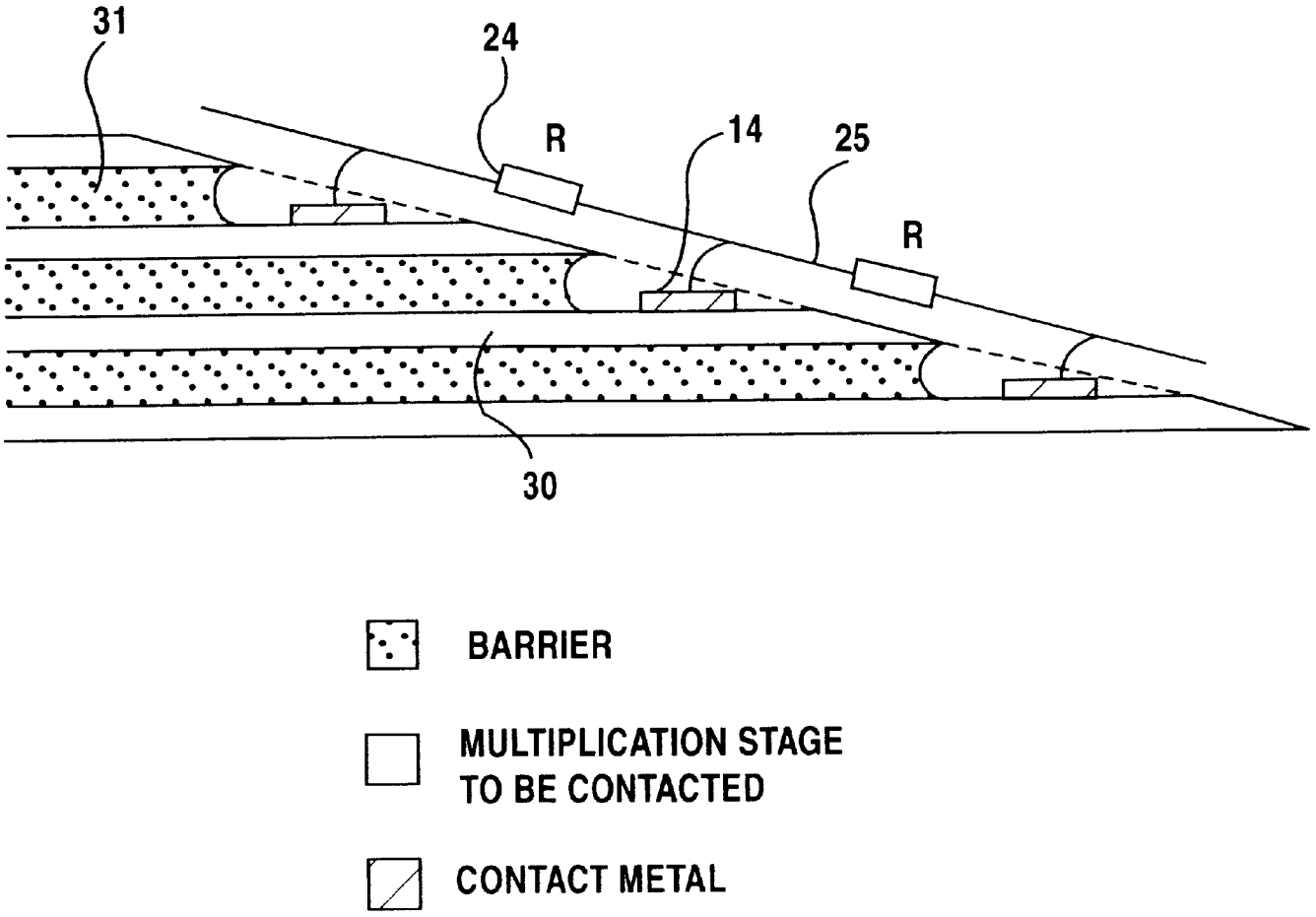

FIG. 42 shows a lapped sample which has been etched selectively for a short time so that only the intermediate layers have become etched.

Figure 43:
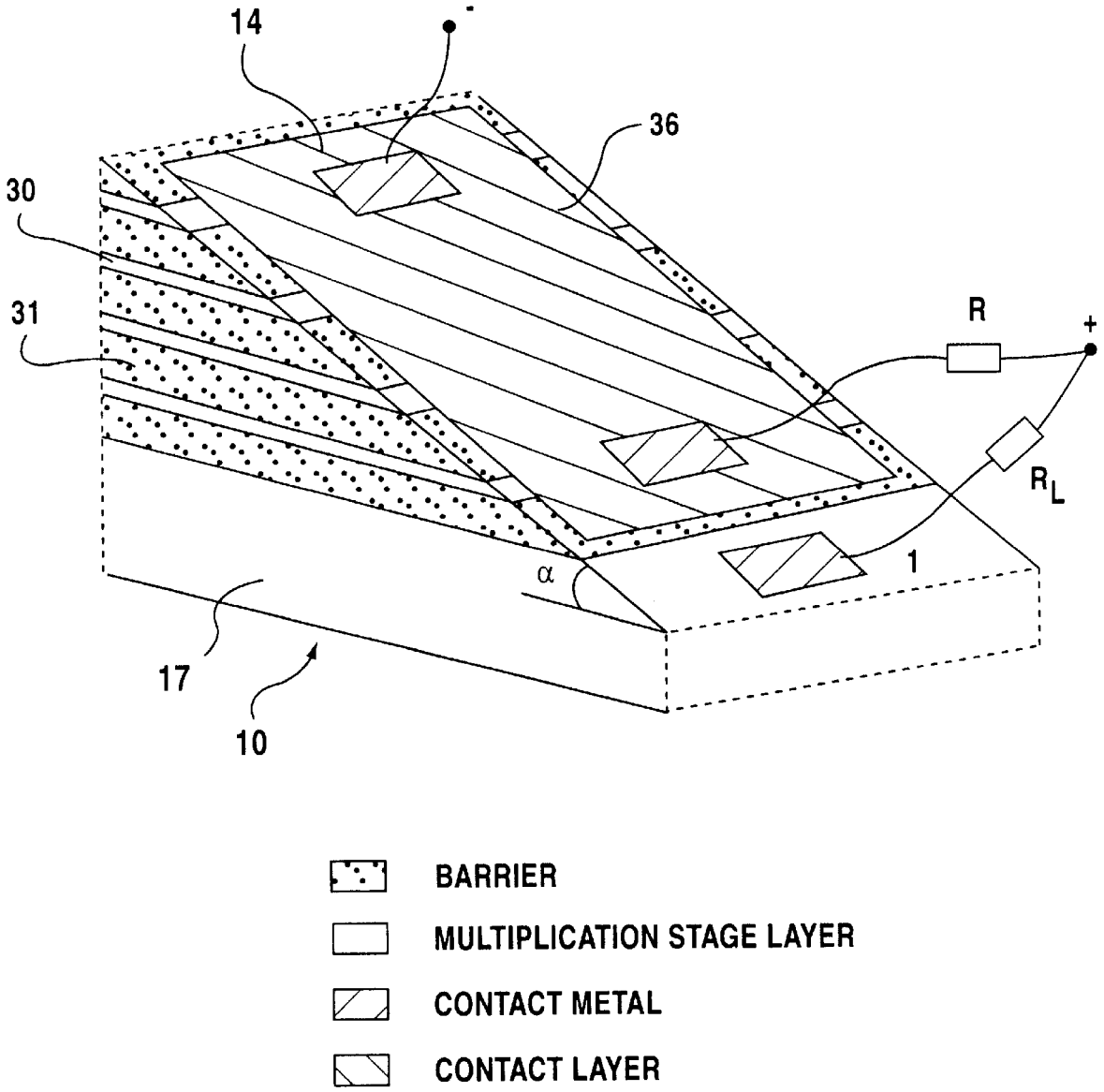

FIG. 43 corresponds to FIG. 42 and shows a multilayer structure lapped to a small angle ($\alpha$), on which the contacts are fabricated to by means of a solid resistive layer.

Figure 44:
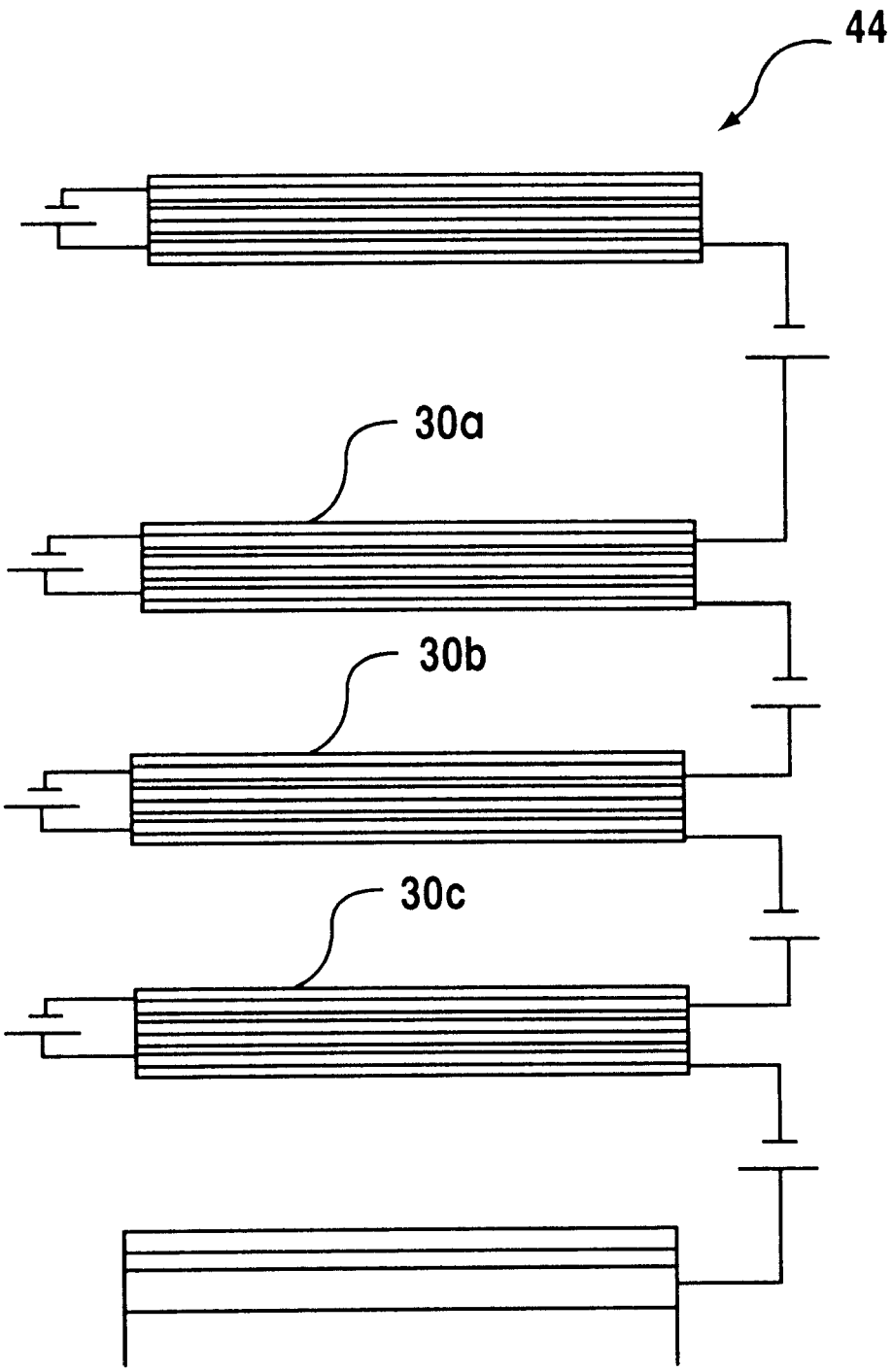

FIG. 44 shows diagrammatically the bias network relating to the invention between the transmission elements, the multiplication stages of the absorption area and the readout stage.

Figure 45:
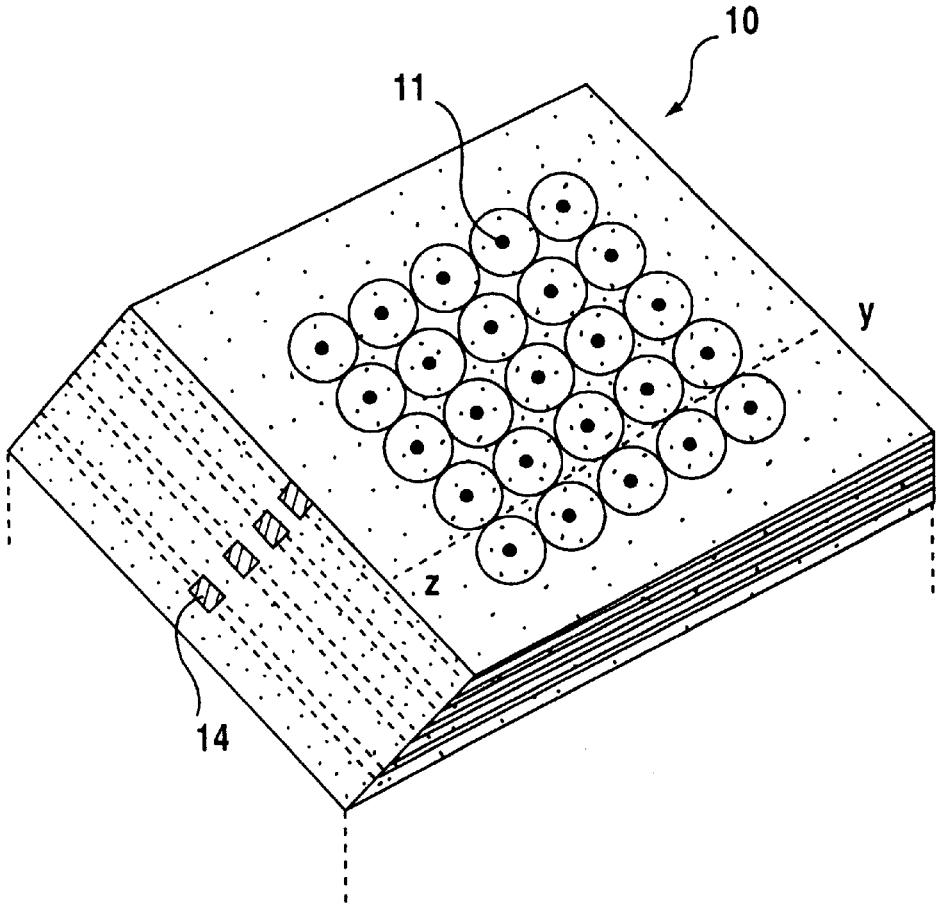

FIG. 45 shows an axonometric view of a vacuum space solid state detector (VSSD).

Figure 46:
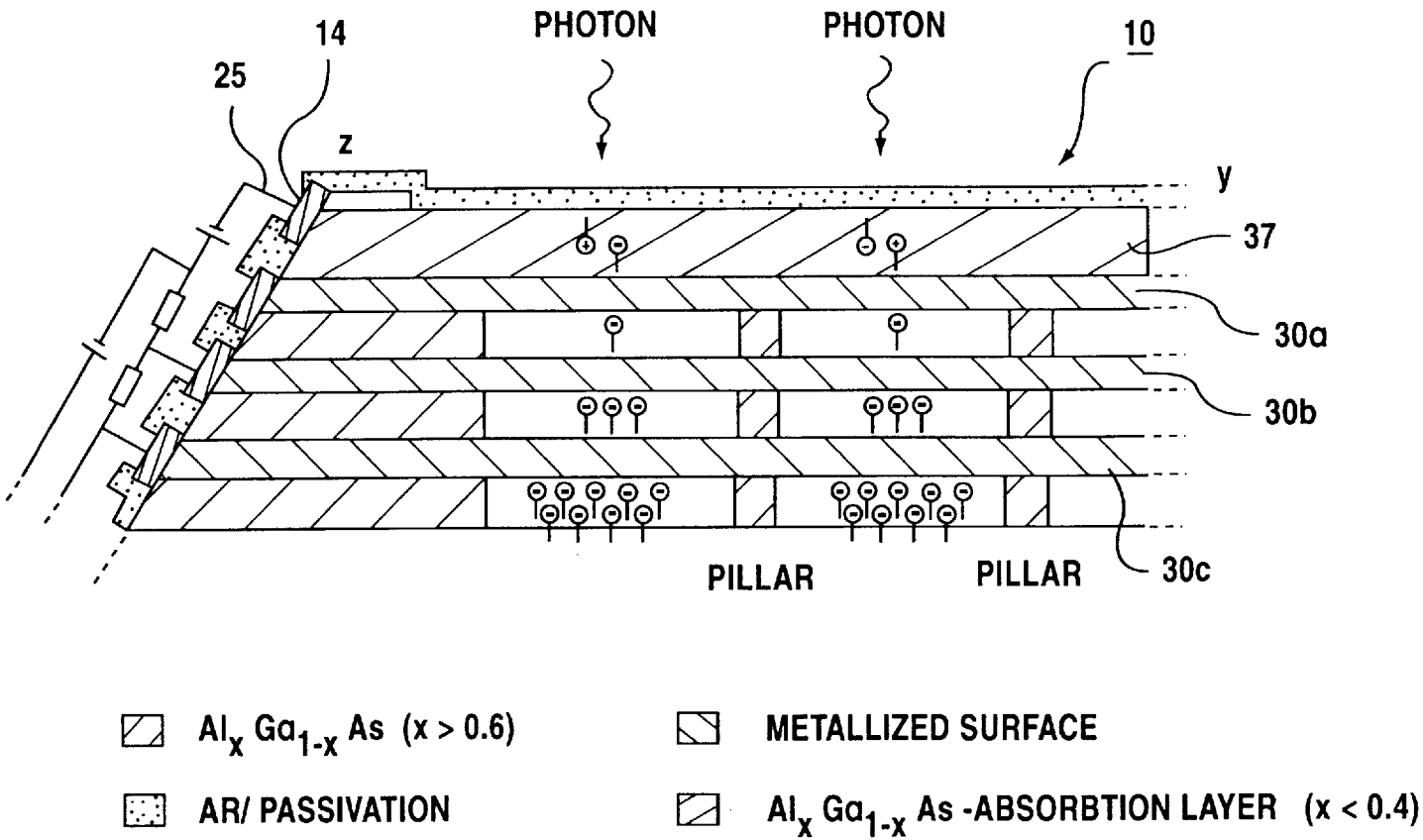

FIG. 46 shows a section of FIG. 45 along the line Y–Z.

Figure 47:
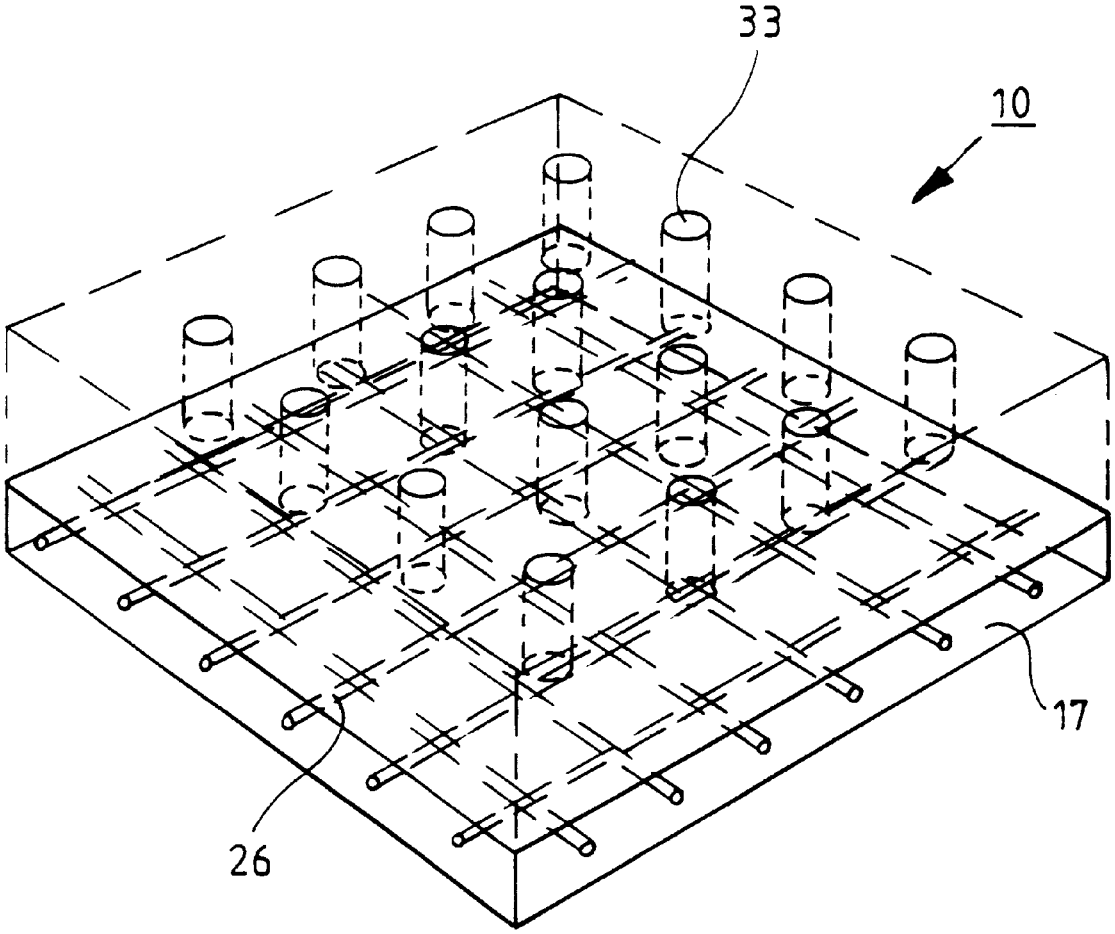

FIG. 47 shows diagrammatically the photon or particle detector provided with a position-sensitive readout stage.

Figure 48:
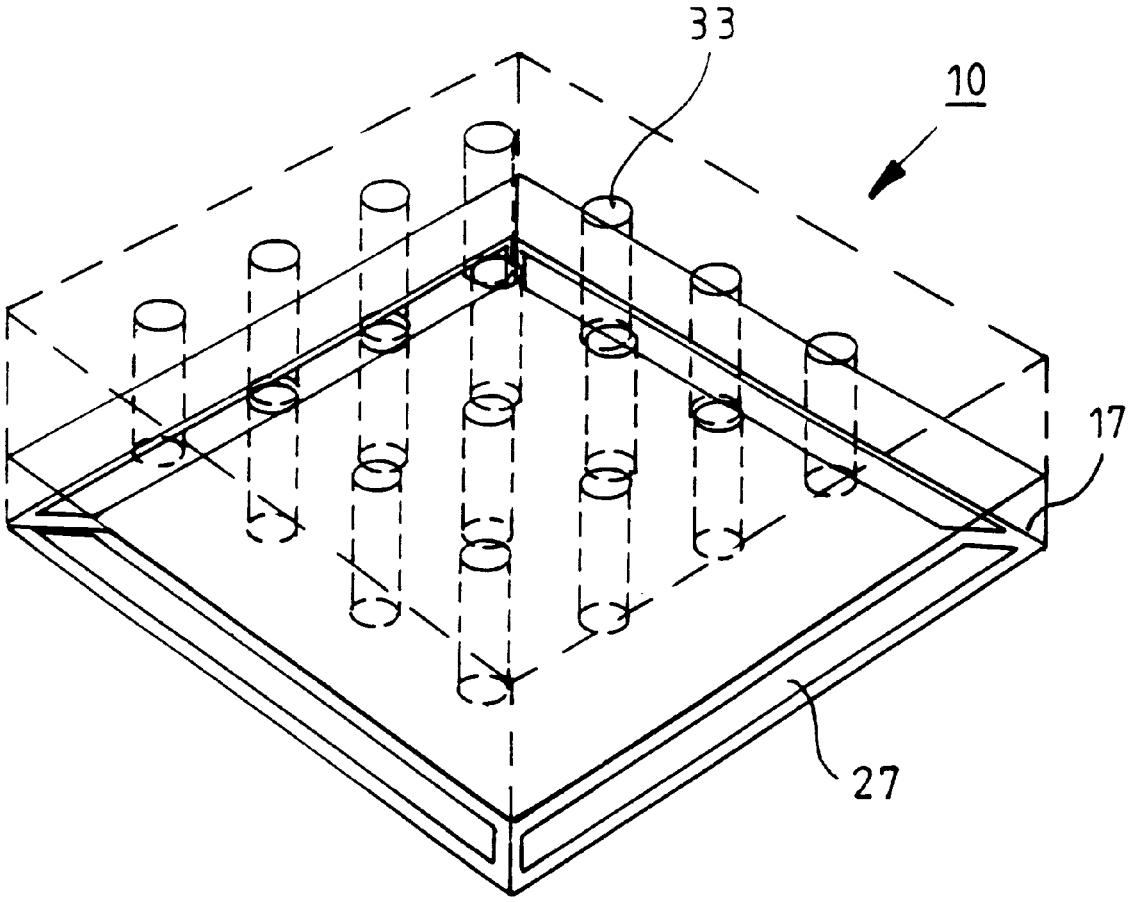

FIG. 48 corresponds to FIG. 47 and shows a diagrammatic view of a detector equipped with a position sensitive device according to another embodiment.

In the figures, the structure is simplified and diagrammatic. The structures may obviously vary even quite considerably, for example, so that the structure may incorporate a large number of pillars and openings required for processing.

Figure 1:
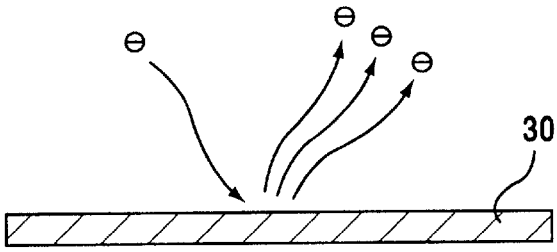
FIG.1 PRIOR ART

FIG. 1 shows a prior art surface emitting dynode which is used in present photomultiplier tubes (PMT). Electrons reach and leave the same surface of the dynode.

Figure 2:
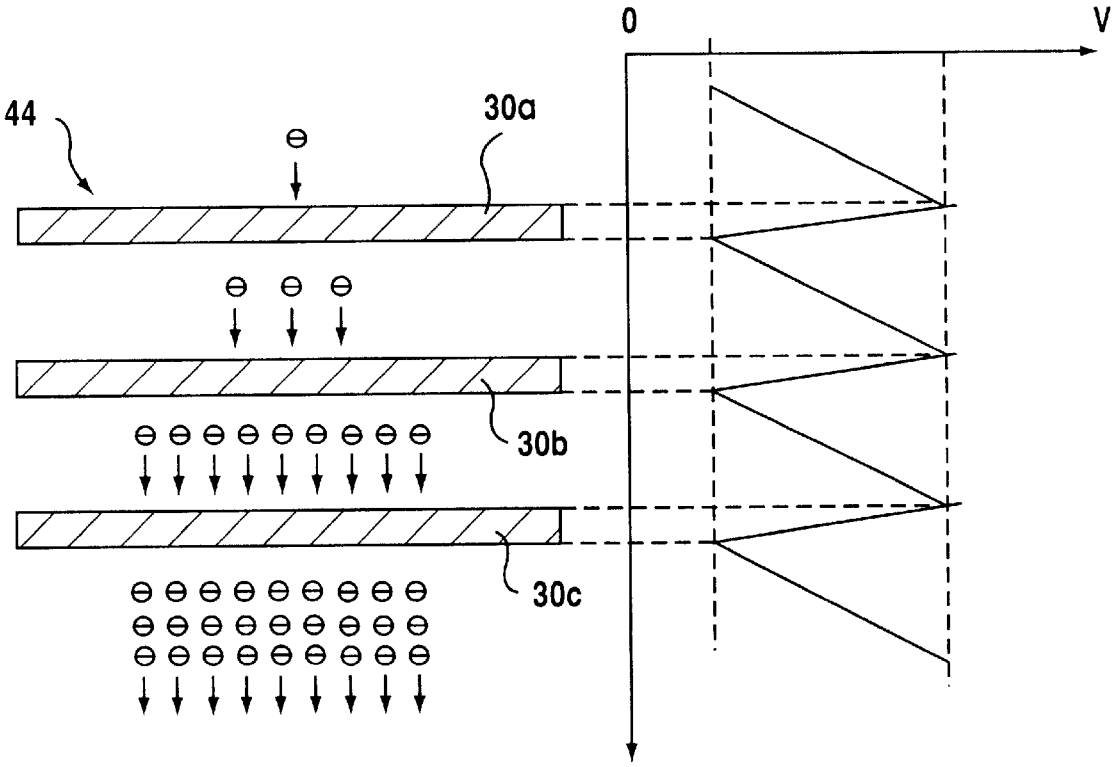
FIG. 2 shows diagrammatically a multiplication region provided with transmission dynodes and the speed distribution of electrons in it.

FIG. 2 shows a prior art multiplication region 44 provided with transmission dynodes. The accelerated electrons hit the dynodes 30*a*, 30*b* and 30*c*, as a result of which the electrons multiply through the ionization of atoms as they pass through the dynode. The electrons released emanate from the opposite side of the dynode.

The speed of the electrons is described diagrammatically by the system of coordinates to the right of the dynodes. It shows that the electrons' speed increases in the vacuum between the dynodes, and decreases when they pass through the solid substance dynode. The aim is that even though the electron's speed slows down inside the dynode, it will be sufficient for the electron to pass through the dynode. The electron emanating from the opposite side of the dynode accelerates again in the vacuum, until it hits the next dynode.

Figure 3:
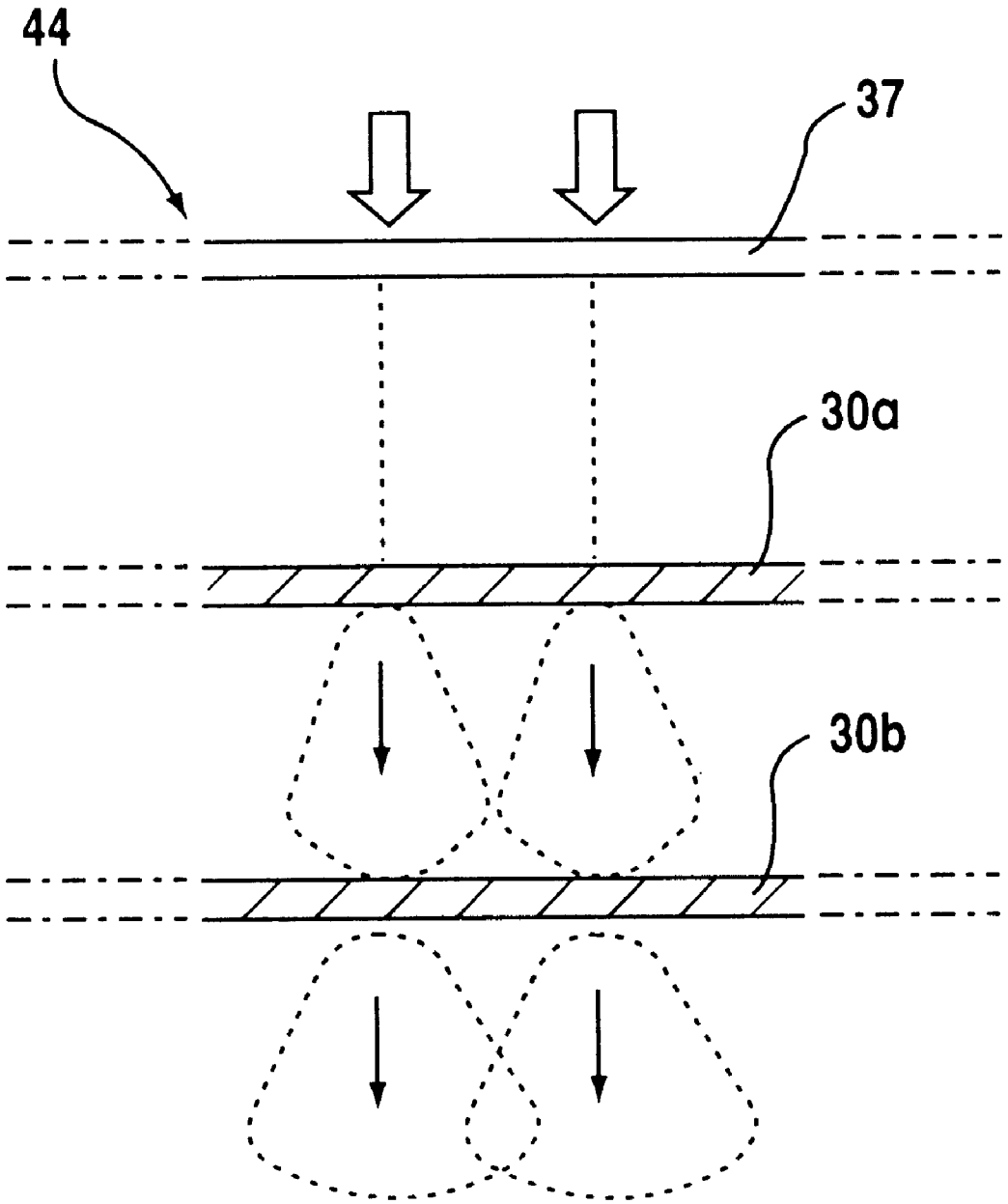
FIG. 3 shows diagrammatically the trajectories of the electrons in the transmission dynodes.

FIG. 3 shows diagrammatically the trajectories of the electrons in the vicinity of the absorption layer 37 and the transmission dynodes 30*a* and 30*b*. In this multiplication region 44, an electrical voltage is provided between the dynodes and the absorption area and the first dynode, in order to increase the speed of electrons between the dynodes.

Figure 4:
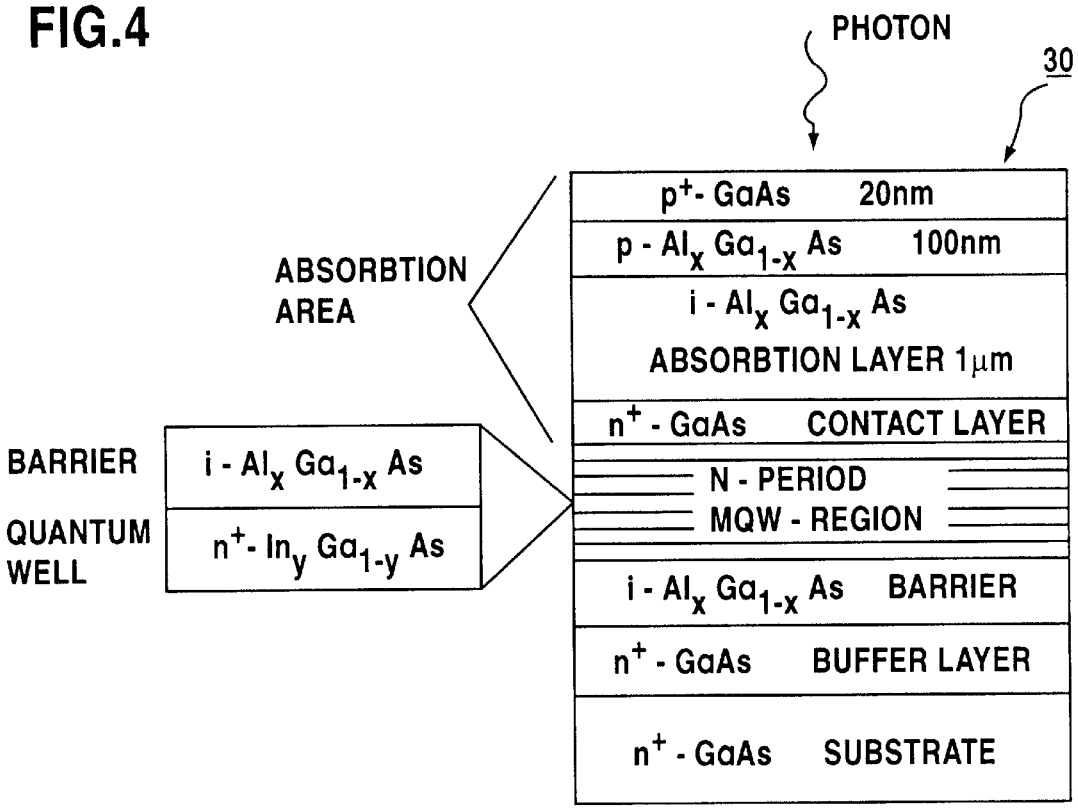
FIG. 4 shows the basic structure of the solid state photomultiplier (SSPM) intended for unipolar multiplication of electrons.

FIG. 4 shows the basic structure of a known solid state photomultiplier (SSPM) intended for unipolar multiplication. The electrons are injected from the p-i-n absorption area into the MQW-multiplication area having N periods Unipolar electron multiplication is detected. The marked contact layers and the substrate are brought into contact with an external circuit, thus creating an electric field within the multiplication region.

Figure 5:
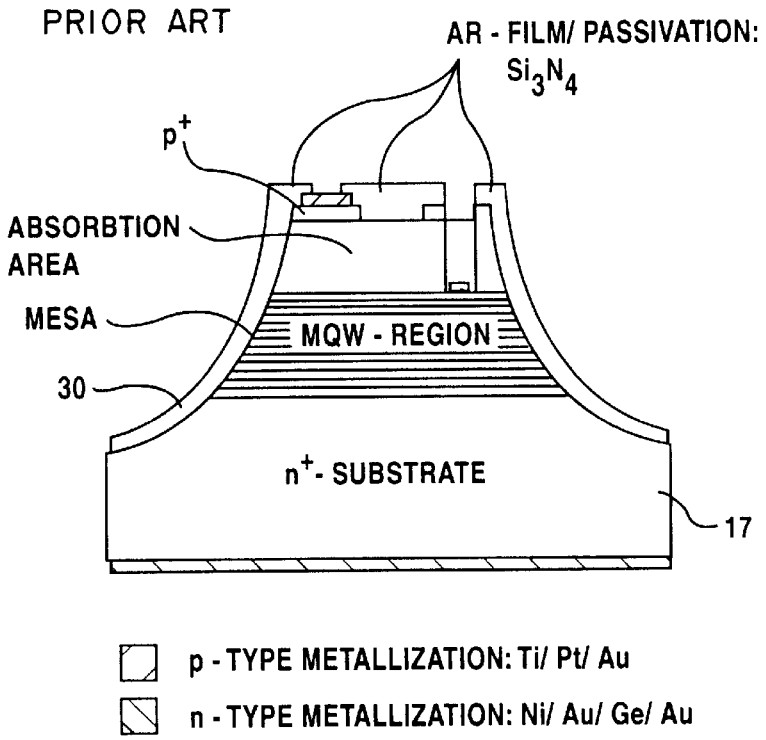
FIG. 5 shows a vertical section of a processed solid state photomultiplier (SSPM).
Figure 6:
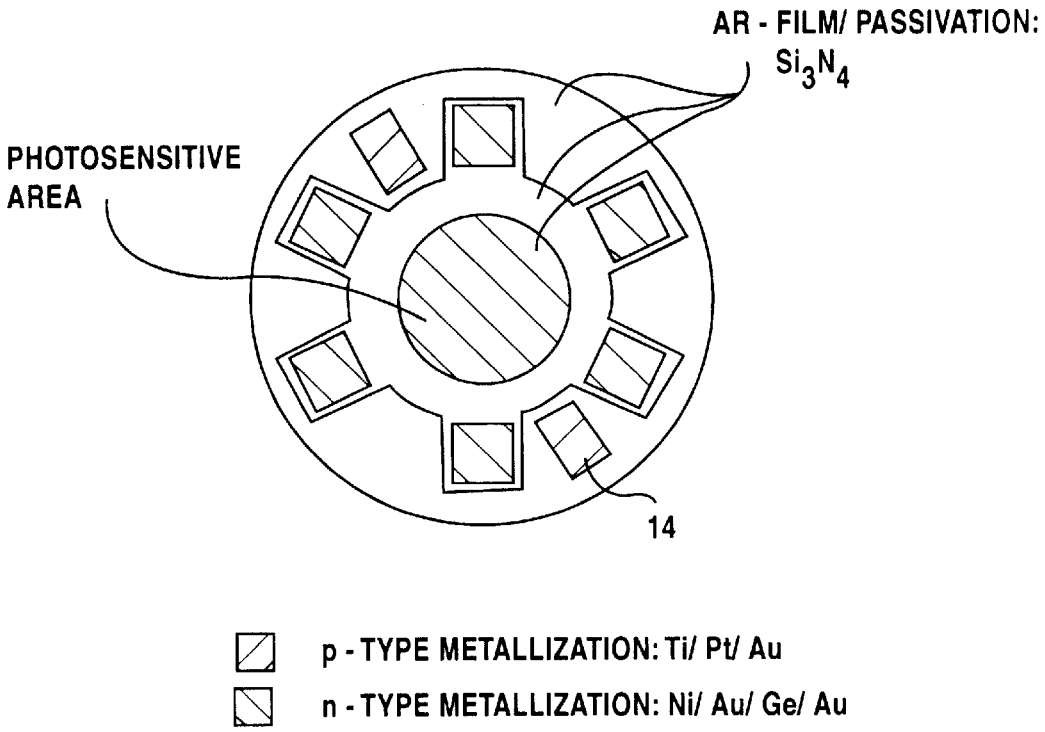
FIG.6 PRIOR ART
FIG. 6 shows the detector of FIG. 5 as seen from above.

FIG. 5 shows a vertical section of a processed solid state photomultiplier (SSPM). The figure shows the contact cavity made by selective etching on the lower edge of the absorption area. FIG. 6 shows the detector of FIG. 5 as seen from above.

FIGS. 7–16 show different embodiments of the detector relating to the invention.

Figure 7:
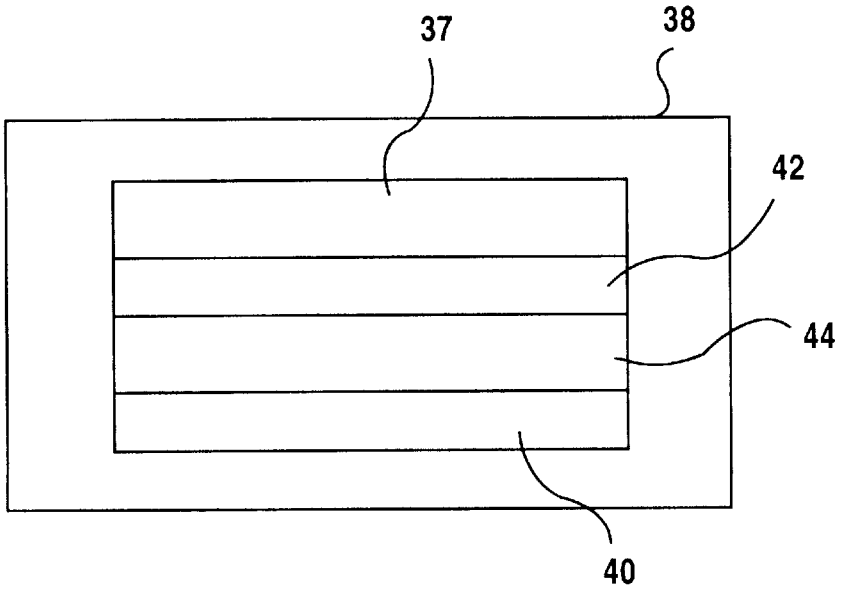
FIGS. 7–16 show different embodiments of the detector relating to the invention.

The detector 10 (VSSD) of FIG. 7 includes an enclosure 38 which maintains the vacuum Inside the enclosure 38 is placed a microstructural monolithic semiconductor structure comprising an absorption area 37, one vacuum space 42, a multiplication stage 44 and a collection anode 40 or other readout stage.

Figure 8:
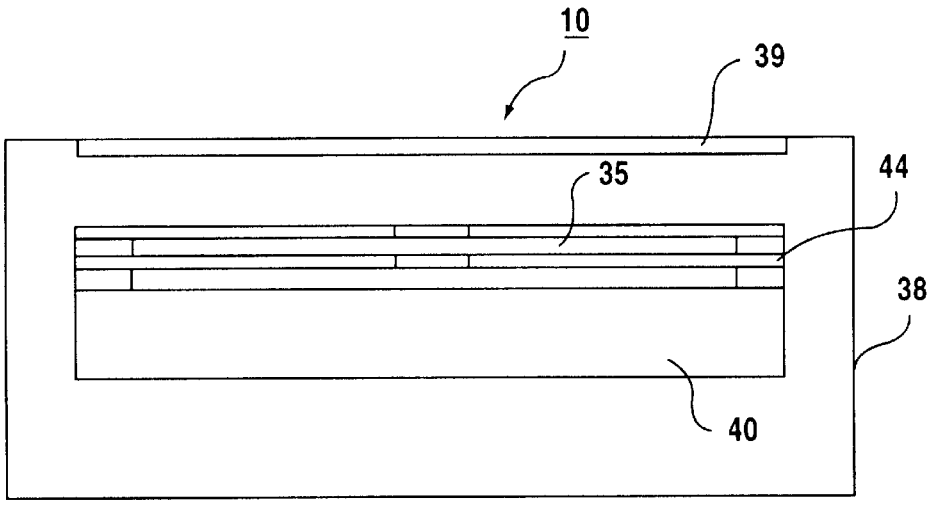

The detector 10 (VSSD) of FIG. 8 includes an enclosure 38 maintaining the vacuum, in the window of which is formed a photocathode 39. Inside the enclosure 38 is placed a microstructural monolithic semiconductor structure comprising a multiplication region 44 provided with cavities 35 forming the vacuum spaces and a readout stage, such as a single collection anode or position-sensitive element, such as a charge coupled device (CCD) 40.

In FIG. 8, as in the following figures, the structure is simplified and diagrammatic. The structures may obviously incorporate a large number of pillars and openings required for the processing.

Figure 9:
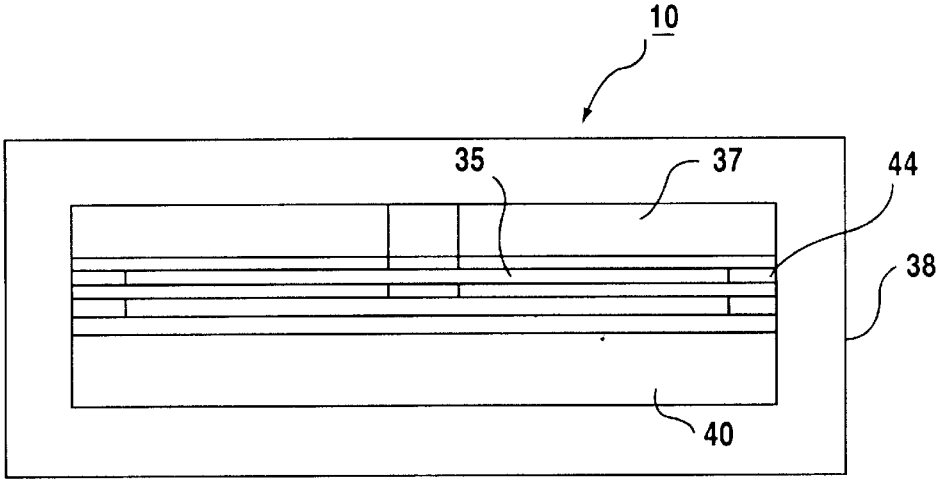

In the detector 10 (VSSD) of FIG. 9 the enclosure 38 does not comprise a photocathode. On the other hand, the monolithic semiconductor structure located inside the enclosure 38 comprises an absorption layer 37, a semiconductor multiplication region 44 provided with cavities 35 that form the vacuum spaces, and a readout stage, such as a single collection anode or position-sensitive element, such as a CCD 40.

Figure 10:
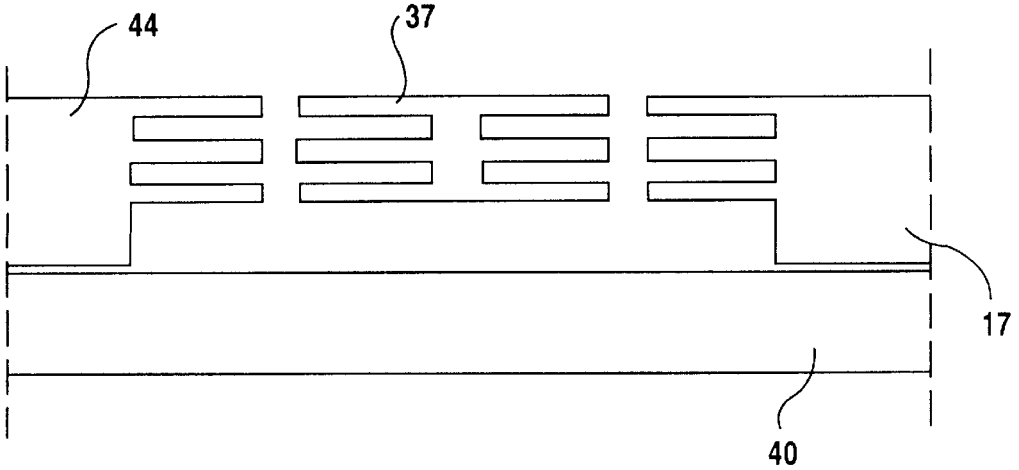

In FIG. 10, a recess has been formed in the semiconductor substrate 17, the recess acting as a vacuum space between the multiplication stage 44 and the CCD element 40 made, for example, on silicon.

Figure 11:
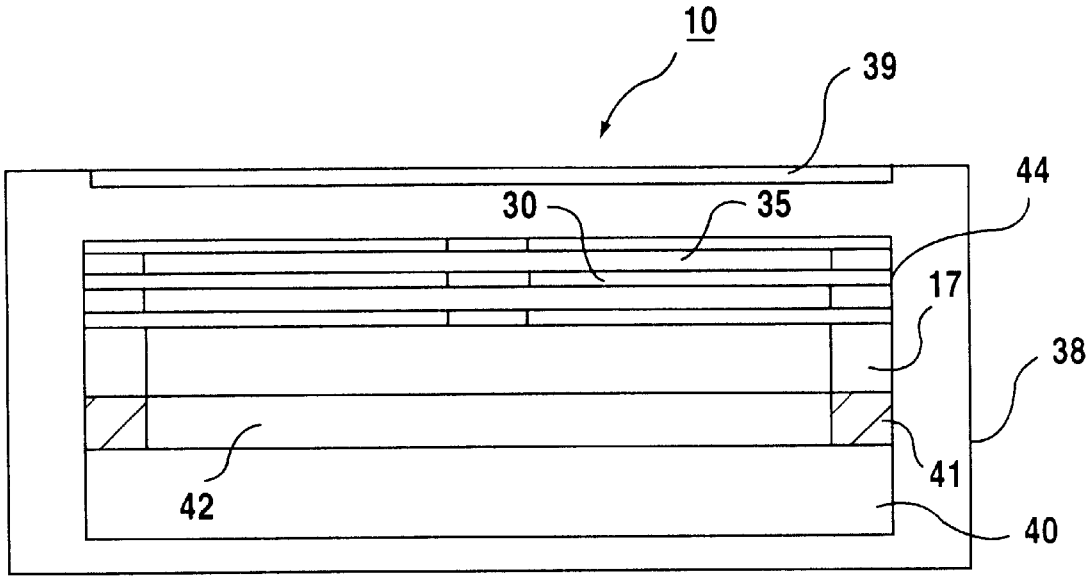
Figure 12:
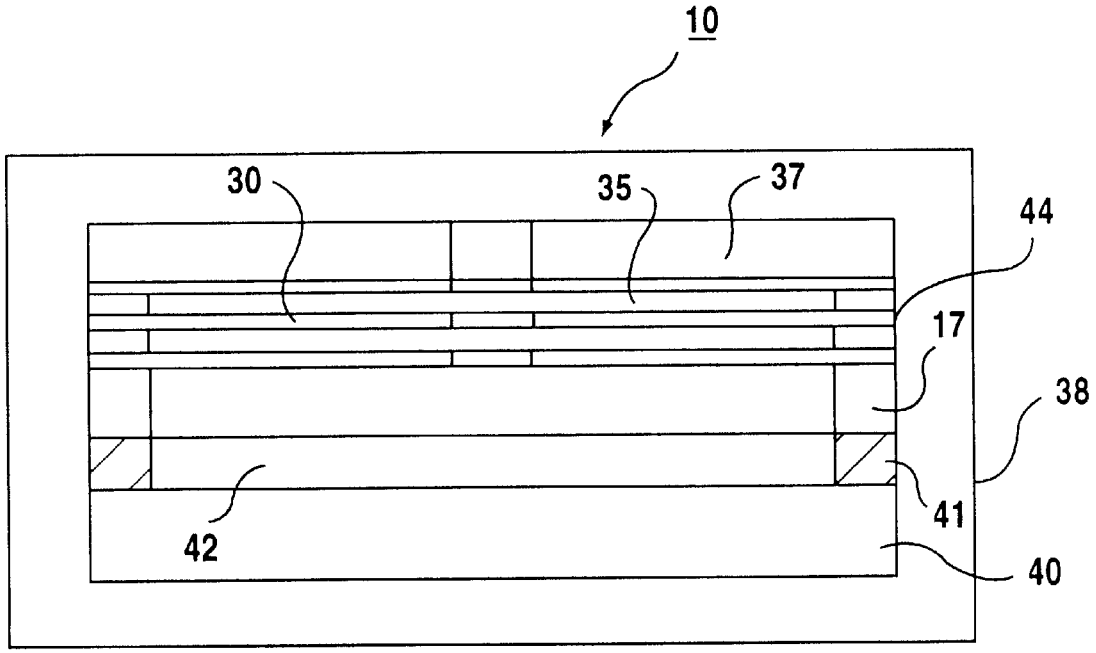

In FIG. 11, the enclosure 38 is provided with a photocathode 39 incorporated in the window. The monolithic semiconductor structure inside the enclosure 38 incorporates a semiconductor multiplication region 44, in which cavities 35 have been formed between the multiplication stages 30, and a semiconductor substrate 17 provided with a recess. The monolithic semiconductor structure is connected by means of intermediate elements 41 to a separate readout element, such as a CCD element 40, so that there remains a vacuum space 42 between them In FIG. 12, there is a monolithic semiconductor structure inside the detector 10 (VSSD) enclosure 38, the said structure comprising an absorption layer 37, a semiconductor multiplication region 44 provided with cavities 35, and a semiconductor substrate 17. The CCD element 40 is connected to the structure on the substrate 17 side through intermediate elements 41.

Figure 13:
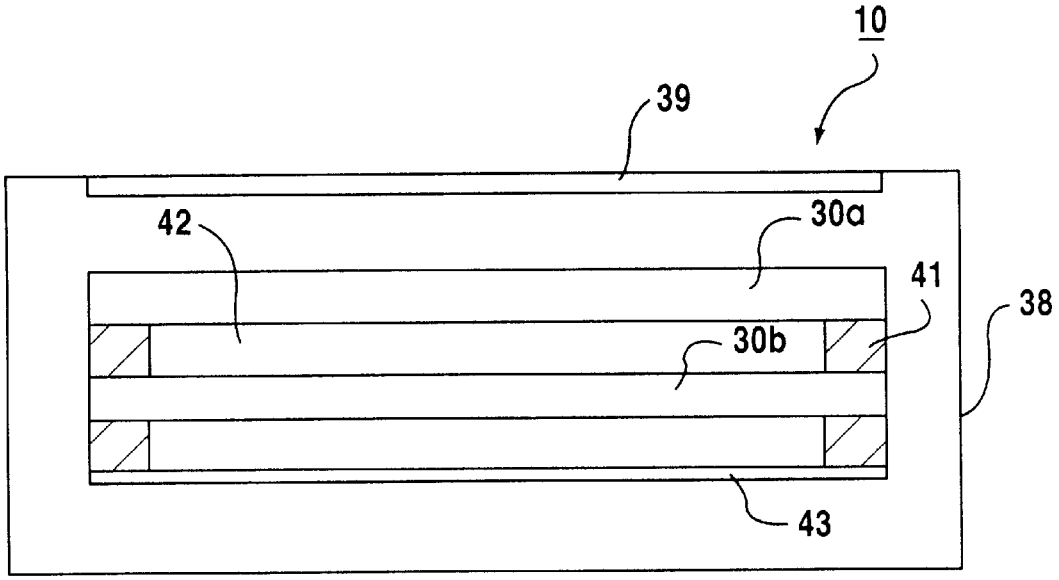

In FIG. 13, the enclosure 38 is provided with a photocathode 39 incorporated in the window. Inside the enclosure 38 are placed the multiplication stages 30*a* and 30*b*, between which there are intermediate elements 41, so that a vacuum space 42 remains between the multiplication stages. The multiplication stages 30*a* and 30*b* are monolithic semiconductor transmission dynodes which are provided with internal contacts for voltage bias. An anode 43 is connected to the structure at a distance from the second dynode 30*b*.

Figure 14:
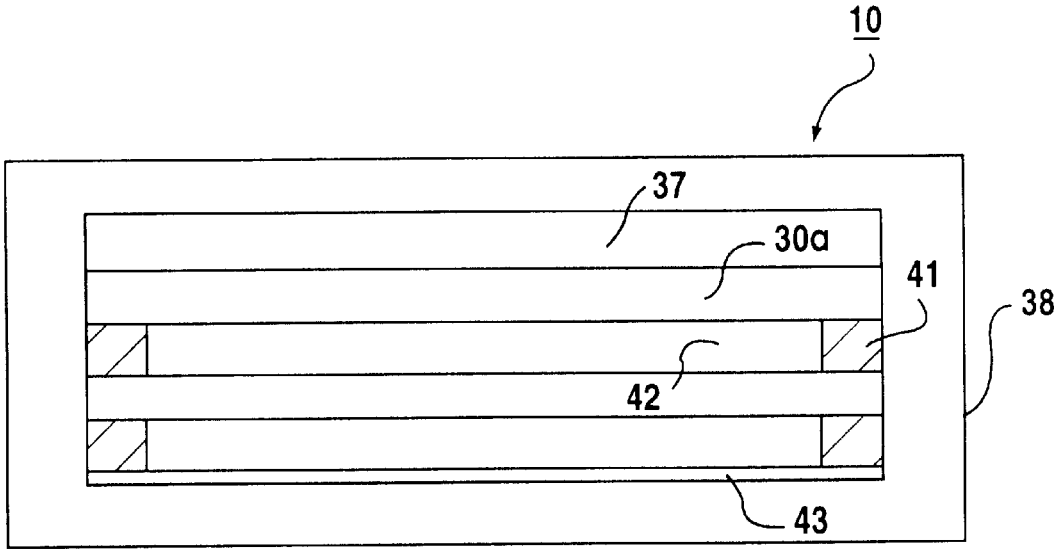

The structure of FIG. 14 corresponds to the structure of FIG. 13 in other respects, except that instead of a photocathode 39, an absorption layer 37 is integrated in the first transmission dynode 30*a*.

Figure 15:
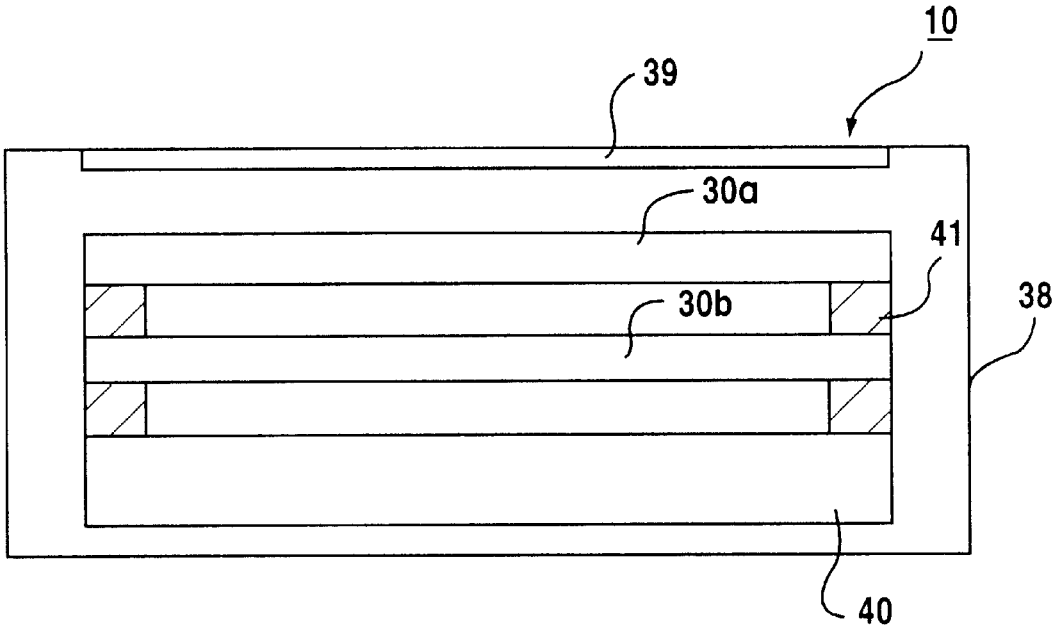

In FIG. 15, the enclosure 38 provided with a photocathode 39 comprises a macrostructural detector, in which the monolithic multiplication stages 30*a* and 30*b* and the CCD element 40 are connected to each other by means of intermediate elements 41.

Figure 16:
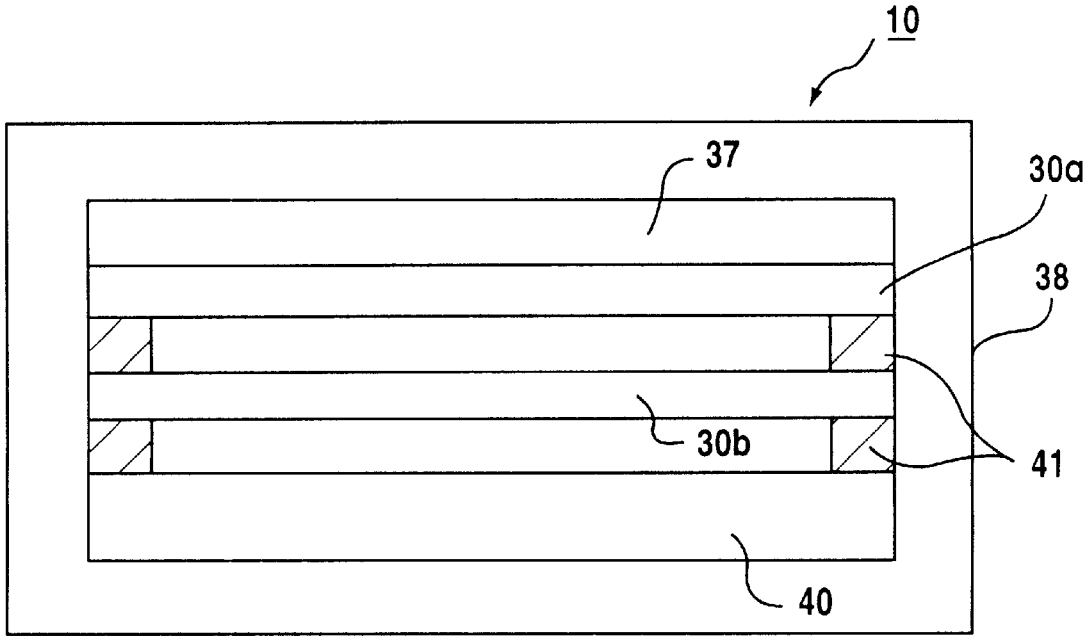
Figure 17:
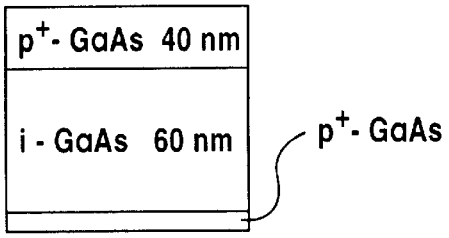
FIGS. 17–26 show examples of the structures of the multiplication stages of solid state detectors (VSSD) provided with one or more vacuum spaces.
Figure 18:
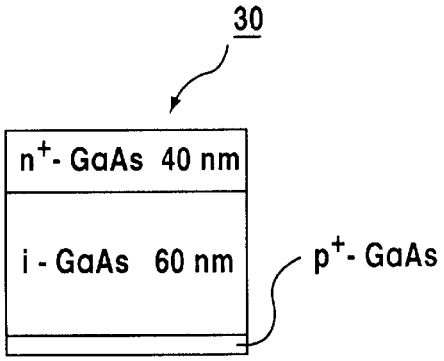
Figure 19:
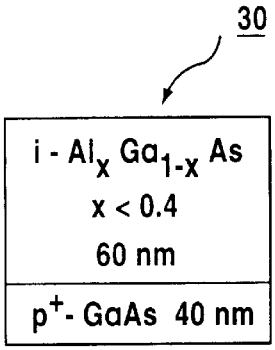
Figure 20:
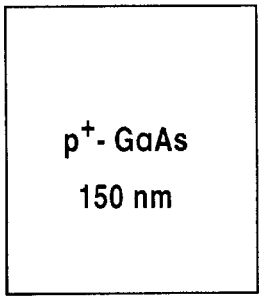
Figure 21:
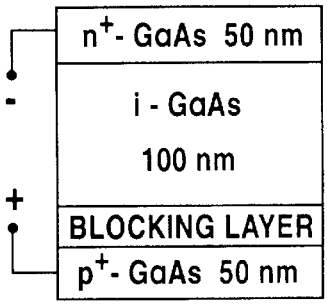
Figure 22:
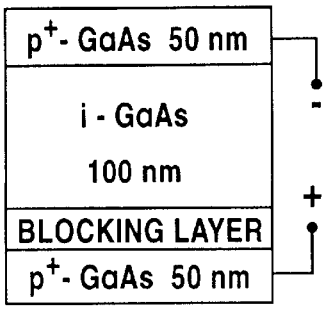
Figure 23:
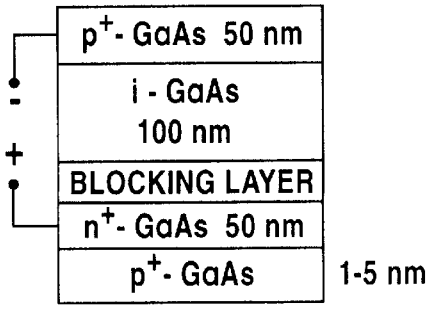

The structure of FIG. 16 corresponds to the structure of FIG. 15 in other respects, except that instead of a photocathode 39, an absorption layer 37 is integrated in the first transmission dynode 30*a*.

FIGS. 17–26 show examples of the structures of the multiplication stages of solid state detectors (VSSD) provided with one or more vacuum spaces on a GaAs substrate. It is possible to make the contact surfaces on the contact layers in structures 17–18 and 20–23 by means of selective etching In structures 19, 25, 26, the contact surface on the contact layer must be made by lapping. All contact surfaces can be made by lapping.

Structure 17 $p^+$—GaAs 40 nm contact layer

Structure 18 $n^+$—GaAs 40 nm contact layer

Structure 19 $p^+$—GaAs 40 nm contact layer

Structure 20 $p^+$—GaAs 150 nm completely a contact layer.

A blocking layer to prevent etching, e.g. InGaP, is required in structures 21, 22 and 23 if the contacts are made by selective etching. In lapping they may be omitted. Each multiplication stage may be separately provided with bias, in which case an intense electric field can be generated within the multiplication stage, if necessary. Multiplication and collection efficiency can thus be increased On the lower surface of each multiplication stage is a $p^+$—GaAs layer for reducing electron affinity by means of a Cs layer. If reducing electron affinity is not necessary from the point of view of multiplication, the lowest $p^+$layer can be omitted. The layer thicknesses given in the figure are merely recommendations.

Figure 24:
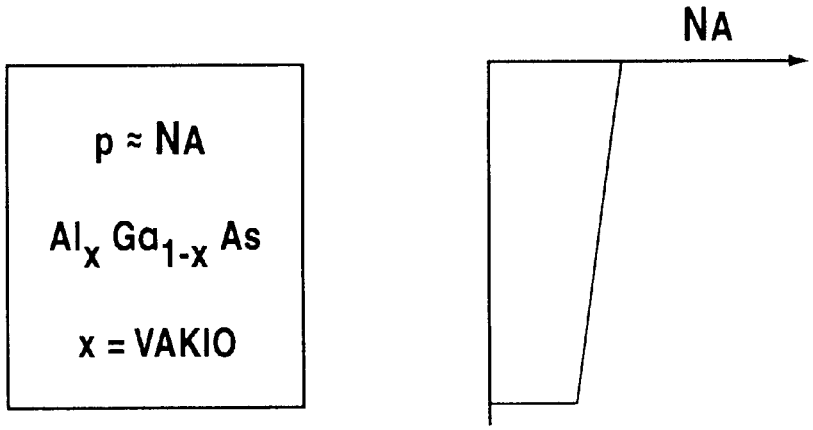

In FIG. 24, the doping concentration ($N_A$=acceptor impurity concentration) inside the multiplication stage has been changed, which creates an internal electric field ($E_{int}$).

Figure 25:
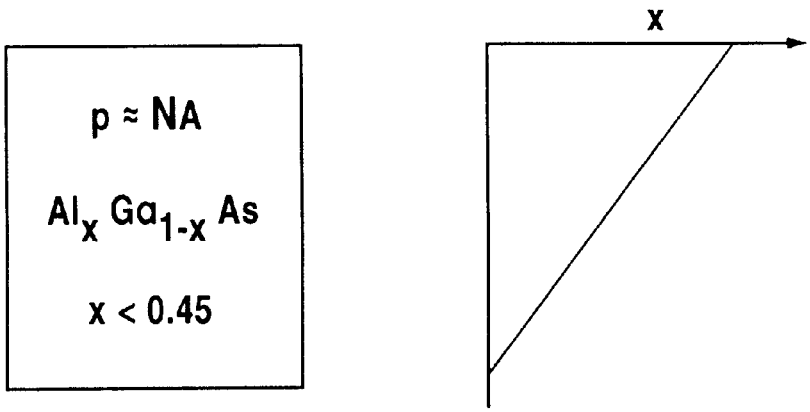

In FIG. 25, the molar ratio of aluminium (x) inside the multiplication stage has been changed, which creates an internal electric field ($E_{int}$) relating only to electrons.

Figure 26:
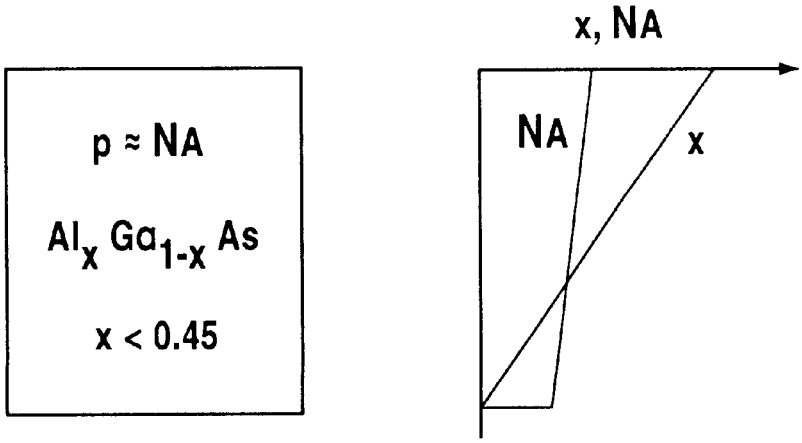

In FIG. 26, both the doping concentration ($N_A$=acceptor impurity concentration) and the molar ratio of aluminium (x) inside the multiplication stage have been changed, which creates an internal electric field ($E_{int}$).

Figure 27:
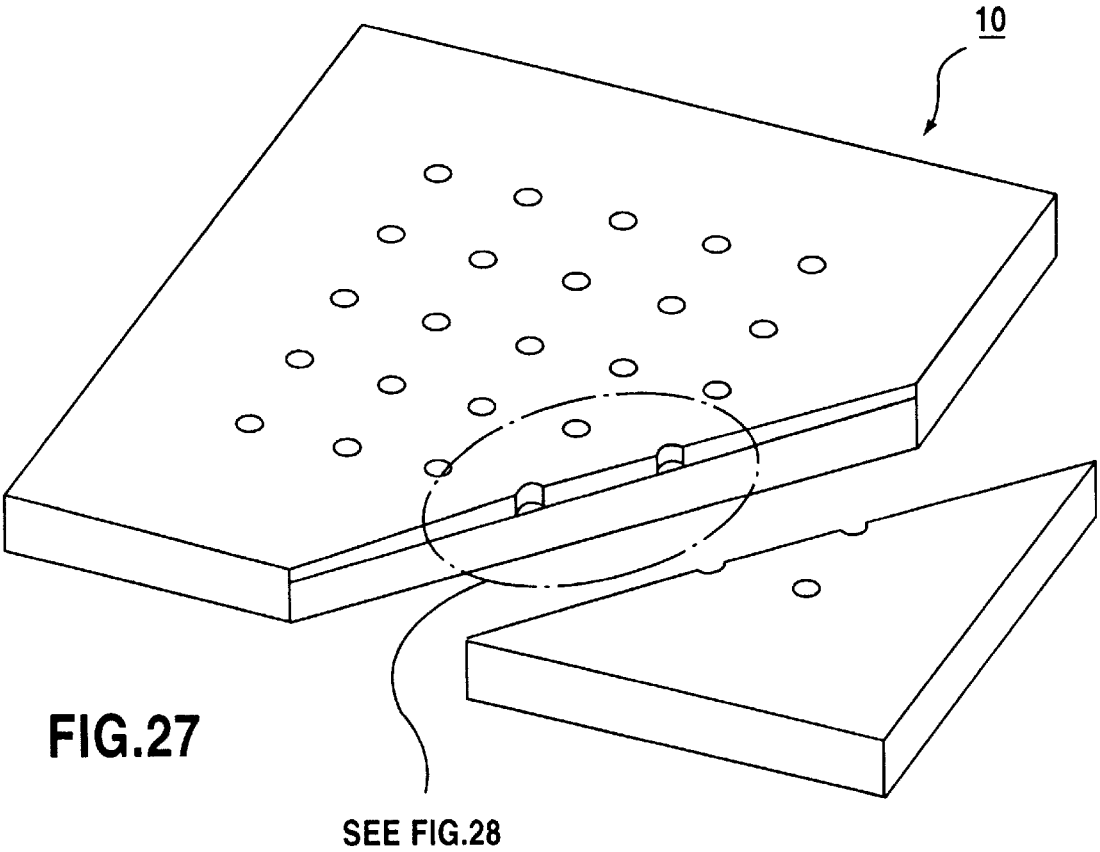
FIG. 27 shows the micromechanical, monolithic semiconductor detector relating to the invention, in which the vacuum cavity is etched by means of a cavity matrix.

FIG. 27 shows the monolithic semiconductor detector (VSSD) relating to the invention, in which the vacuum spaces have been etched selectively by means of a cavity matrix.

Figure 28:
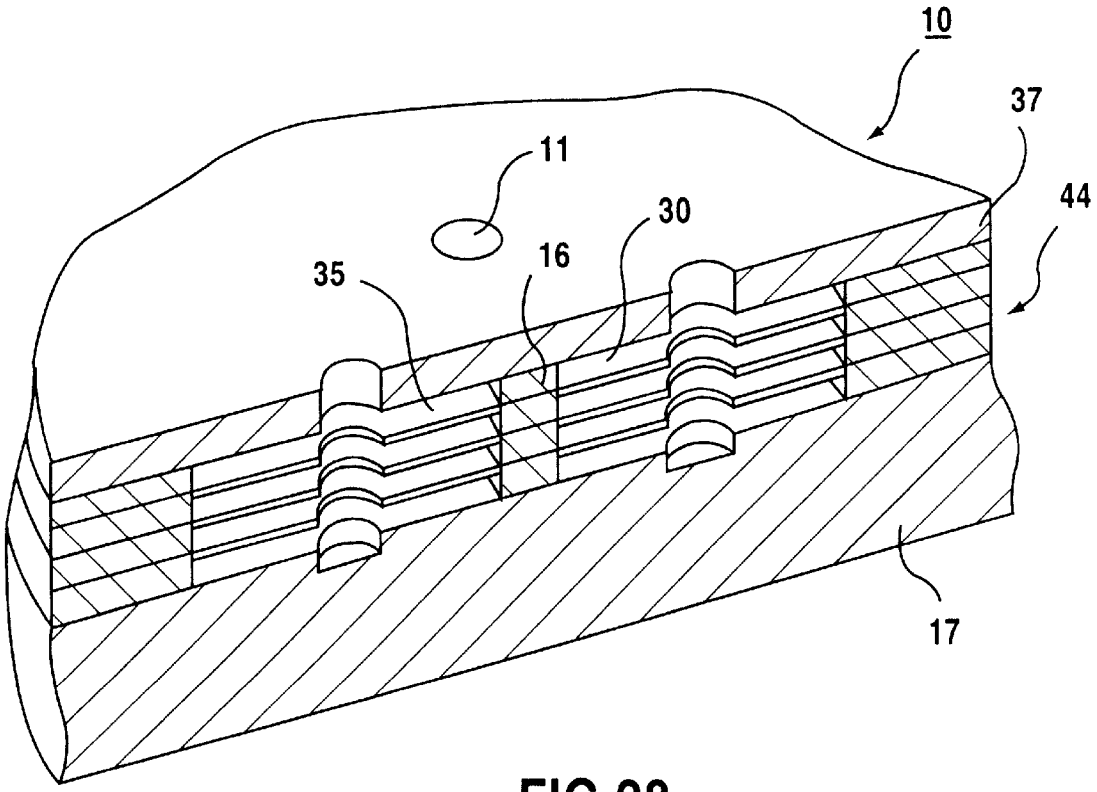
FIG. 28 is a section showing the vacuum structure (VSSD) etched through the cavity matrix.
Figure 29A:
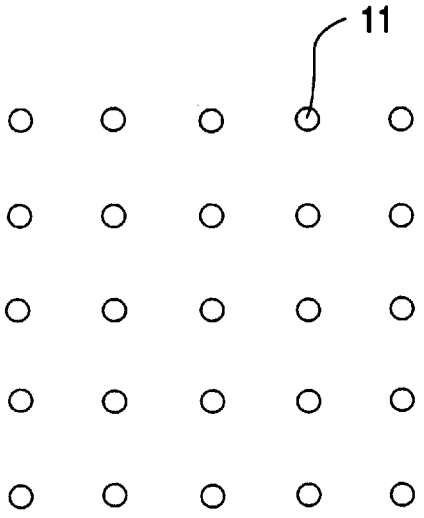
Figure 29B:
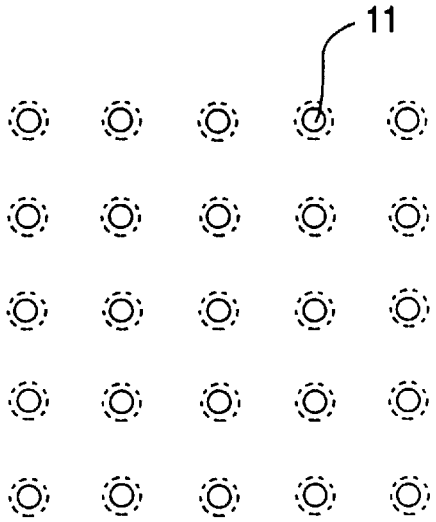
Figure 29C:
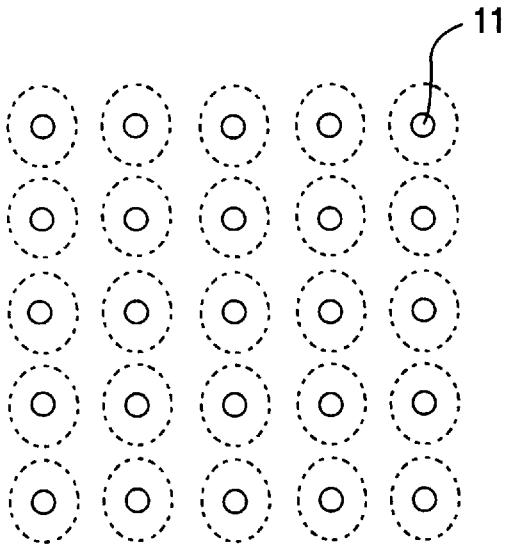
Figure 29D:
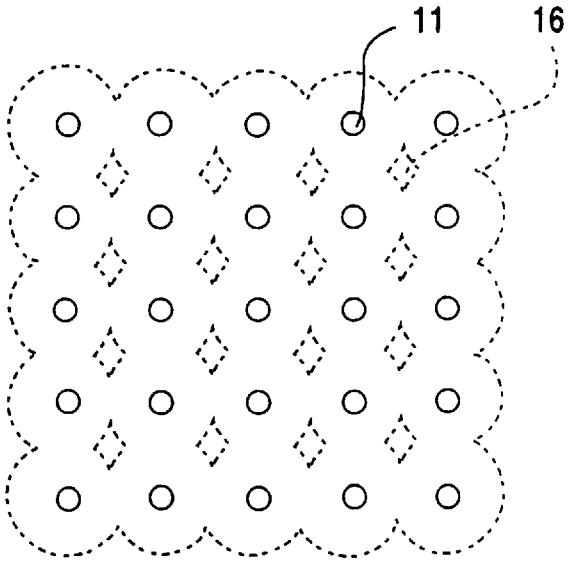

The cross-sectional view in FIG. 28 shows the cavities which extend down to the substrate of the multilayer structure of the monolithic semiconductor detector (VSSD). A vacuum structure forming cavities 35 has been etched to the detector through the cavity matrix, the said structure comprising three multiplication stages, or transmission dynodes. The transmission dynodes are shown as thin unetched layers. One pillar 16 always remains in the middle, between the openings 11.

FIG. 29 shows an example of the etching of a vacuum space or spaces of the solid state detector (VSSD) relating to the invention through cavity matrices. In 29*a*, a cavity matrix has been etched in the monolithic semiconductor blank of the detector through the desired structure At 29*b*, the selective etching solution penetrates through the cavities inside the multilayer structure, and the intermediate layers begin to be etched. At 29*c*, the etched pattern shown by a broken line extends with time under the surface and at 29*d* only the pillars (♦) have remained to support the structure together with the edges.

FIG. 30 corresponds to FIG. 29 and shows another example of the fabrication of the vacuum structure in a vacuum space solid state detector (VSSD). At 30*a*, square openings are made by etching through the desired structure At 30*b*, etching progresses under the surface, and at 30*c* only thin walls remain. A pattern has thus been formed in which the detector incorporates "separate" detectors. The advantage of these is accurate determination of position, because in this way the sideways dispersion of electrons is restricted On the other hand, the relatively large proportion of walls may increase dark current. At the same time it increases wasted area from the point of view of photosensitivity.

FIGS. 31—33 show a diagrammatic and a sectional view of the fabrication of the detector according to another method. In this embodiment, shafts are first made at the support pillars between the layers, as shown in FIG. 31. The shafts are then filled with polyimide or other material that etches slower than the intermediate layers, as shown in FIG. 32. The intermediate layers are then removed by etching, thus leaving only the transmission dynodes and their supporting polyimide pillars in the multiplication region, as shown in FIG. 33.

FIG. 34 shows diagrammatically the matrix of the detector in which the polyimide pillars 33 supporting the transmission elements are positioned at the corners of the pixels. In this embodiment etching takes place from three sides, through the etching channel 34 shown in the figure. The contacts of the transmission elements are made on the side that is on the left in the figure and which remains unetched.

FIG. 35 shows a detector matrix corresponding to FIG. 34, in which an opening has been left in one corner of the etching channel. This corner remains unetched and thus transmission element contacts have been made in it by utilizing lapping technique.

FIG. 36 shows a vertical section of the detector 10 in which contacting points 14 have been made for connecting wires. The thin layers 13 of the detector 10 are, for example, GaAs layers and the intermediate layers that have been eroded by etching are $Al_xGa_{1-x}As$ layers (x>0.5).

FIG. 37 shows diagrammatically the contacts made in a multilayer structure by means of selective etching. Separate shafts have been made by etching in each multiplication stage layer, which shafts have then been provided with contacts and connected with each other by means of resistors. Therefore, the external voltage can be distributed between the multiplication stages in the desired manner by means of resistors.

FIG. 38 shows a solid state detector (VSSD) provided with at least one vacuum space, as seen from above, in which detector contacts have been etched by selective etchings FIG. 39 shows a sectional view of the detector of FIG. 38. The shaft matrix is shown on the surface of the sample. If the molar ratio in the AlGaAs layer is greater than 0.5, selective etching is possible.

FIG. 40 shows a multilayer structure lapped to a small angle (α), in which each layer is separately provided with contacts. The layers of a multilayer structure can be exposed on the surface of the sample by lapping. The width (Z) of the layer on the surface of the sample depends on the lapping angle ($\alpha$).

FIG. 41 shows a section of the inclined plane 12 of the detector 10. The direction of growth of the film is shown in the figure by an arrow directed upwards. For the angle of inclination of the inclined plane to be sufficient, angle a must be at least about 0.1–0.2°. From this it follows that $$\frac{l_{QW}}{x_{QW}} = \sin 0.1°;\ x_{QW} = \frac{l_{QW}}{\sin 0.1°},\ \text{in which case}$$

As the different layers ($\mathbf{1}_{Qw}$) are exposed more widely ($x_{Qw}$) on the surface of the sample when the angle is small, the multiplication stage layers can be metallized by lithography and ohmic contacts can be connected to each multiplication stage layer.

FIG. 42 shows a lapped sample which has been etched selectively for a short period so that only the intermediate layers have been etched. In this way, the surfaces to be contacted can be extended and the steplike structure can be produced.

FIG. 43 shows a multilayer structure lapped to a small angle ($\alpha$), in which the layers are brought into contact by means of a solid contact layer 36 placed over the multiplication layers. It forms a film resistor network on the inclined plane, by means of which network the external voltage can be suitably distributed. The layer must be appropriately resistive in order for the film resistor to act as a suitable "resistor network" between the different contact layers. If the substrate is of conductive material, for example, InP ($p^+$or $n^+$) or GaAs ($p^+$or $n^+$), the so-called anode contact can be taken from the bottom.

The substrate contact, that is, the anode contact 1 is on a inclined plane in a case where the substrate is insulating, for example:

SI—InP or SI—GaAs, where SI=Semi-Insulating

A conductive layer is grown for the anode contact on the insulating substrate. The contact metal is then evaporated onto this layer. A load resistor ($R_L$) from which the output is taken is connected to the anode contact. The example shown in the figure comprises four multiplication stages. The surface contact of the absorption layer is not shown in the figure.

In FIG. 44, the transmission dynodes 30*a*, 30*b* and 30*c* are arranged in layers. By making contacts at least two layers of the dynode, an electric field is created by means of external voltage, also inside the dynodes.

FIG. 45 shows an example of a multilayer structure in which the shaft matrix is shown on the flat part of the surface and the contact areas on its lapped, inclined surface.

FIG. 46 shows a vertical section of the structure of FIG. 45. The figure shows the structure of the solid state detector provided with a vacuum space or spaces (VSSD), the contact layers of which are provided with contacts by lapping technique. The contact areas and the external resistor network are shown on the left of the sectional figure. An example of the multiplication of electrons in a vacuum space solid state detector (VSSD) is shown diagrammatically inside the vacuum structure.

FIG. 47 shows a detector 10, on the surface or bottom of the GaAs substrate 17 of which is located a readout stage formed of grid-like conductor network 26, by means of which the photon or particle reaching the surface of the detector can be located. This readout stage may be integrated in the same monolith as the amplification stage, as in FIG. 47, or it may be situated in a separate monolithic part.

FIG. 48 shows a detector 10 on the substrate 17 of which is arranged a readout stage which consists of a resistive film and electrodes 27 measuring charge distribution, by means of which a photon or particle reaching the surface of the detector can be located. This readout stage may be integrated in the same monolith as the amplification stage, as in FIG. 48, or it may be situated in a separate monolithic part.

It is obvious to a person skilled in the art that the different embodiments of the invention may vary within the scope of the claims presented below.

We claim:

1. A photon or particle detector comprising a photon or particle absorption region, a multiplication region consisting of one or more transmission elements and an electron collection anode, said detector being surrounded by a vacuum-tight enclosure, characterized in that the detector comprises at least one monolithic semiconductor structure, in which structure electrons are arranged so as to travel from at least one semiconductor layer of said structure into a vacuum space of said structure, either directly or through a medium.

2. A detector as claimed in claim 1, characterized in that at least one of the transmission elements is at least partly a semiconductor structure.

3. A detector as claimed in claim 1, characterized in that at least a part of the multiplication region is formed into a layered structure comprising at least one doped semiconductor layer acting as a transmission-mode electron multiplication element and at least one vacuum space.

4. A detector as claimed in claim 1, characterized in that at least a part of a multiplication region is formed into a monolithic, micromechanical, layered structure comprising at least one semiconductor transmission dynode and at least one vacuum cavity.

5. A detector as claimed in claim 1, characterized in that the detector comprises at least one monolithic and layered semiconductor structure incorporating at least two transmission multiplication elements made of one or more material layers, there being vacuum cavities on both sides of each element.

6. A detector as claimed in claim 1, characterized in that the detector comprises at least one monolithic semiconductor structure comprising a layered multiplication region and an absorption area.

7. A detector as claimed in claim 1, characterized in that at least two monolithic semiconductor structures are placed on top of each other so that a cavity exists between them.

8. A detector as claimed in claim 1, characterized in that the detector comprises at least one monolithic semiconductor structure including a layered multiplication region and a position-sensitive readout stage incorporated in the same structure.

9. A detector as claimed in claim 1, characterized in that the detector comprises at least one first monolithic semiconductor structure incorporating a layered multiplication region and at least one second monolithic semiconductor structure incorporating a position-sensitive readout stage.

10. A detector as claimed in claim 1, characterized in that the detector is made into a layered structure so that two monolithic semiconductor elements are separated from each other by means of an intermediate element so that a vacuum space is formed between them.

11. A detector as claimed in claim 1, characterized in that in the detector, two semiconductor transmission dynodes, or a semiconductor transmission dynode and a readout stage are separated from each other by means of an intermediate element.

12. A detector as claimed in claim 1, characterized in that the detector includes a plurality of transmission multiplication elements and means for providing an electrical voltage between the transmission multiplication elements.

13. A detector as claimed in claim 1, characterized in that inside at least one stage of the detector there exists an internal electric voltage or an externally applied electric voltage or both voltages.

14. A detector as claimed in claim 1, characterized in that the detector includes at least one of a semiconductor transmission dynode or an absorption region, at least one of which has a graded dopant concentration for creating an internal electrical field therein.

15. A detector as claimed in claim 1, characterized in that the detector includes a transmission dynode having a layered structure and one or more contacts connected to the transmission dynode or its layers.

16. A method for fabricating a photon or particle detector comprising depositing at least one monolithic semiconductor structure comprising a multiplication region and an absorption area and forming a vacuum space within said multiplication region such that during detection electrons created during absorption in said absorption region or during multiplication inside said multiplication region travel into said vacuum space, either directly or through a medium.

17. A fabrication method as claimed in claim 16, characterized in that at least the multiplication region of the detector is layered to form a monolithic, micromechanical layer structure including transmission dynodes and at least one cavity, which forms a vacuum space between the transmission dynode layers, is formed in said structure by etching.

18. A fabrication method as claimed in claim 16, characterized in that said at least one monolithic semiconductor structure comprises a layered multiplication region and a position-sensitive readout stage, such as a CCD element.

19. A fabrication method as claimed in claim 16, comprising forming one or more shafts extending through one or more layers of the detector structure and etching desired layers through said shafts to form cavity regions.

20. A fabrication method as claimed in claim 16, characterized in that desired regions of the detector structure are irradiated by means of a large and energetic proton or ion flux so that said regions resist etching.

21. A fabrication method as claimed in claim 19, characterized in that a substance that resists etching is formed in a set of said shafts before said etching of said cavities to form support pillars.

22. A fabrication method as claimed in claim 16, characterized in that shafts for transmission dynode contacts are formed by selective etching.

23. A fabrication method as claimed in claim 16, characterized in that transmission dynode contacts are formed by lapping an inclined plane on the detector structure, and depositing separate contacts on said plane for transmission dynode layers.

24. A fabrication method as claimed in claim 16, characterized in that transmission dynode contacts are made by lapping an inclined plane on the detector structure, and depositing a thin film resistor on said plane.

* * * * *